US012768133B2

(12) United States Patent
Nuhn

(10) Patent No.: US 12,768,133 B2
(45) Date of Patent: Oct. 20, 2026

(54) BOOM MOUNTED PUMP

(71) Applicant: Nuhn Industries Ltd., Sebringville (CA)

(72) Inventor: Ian Dennis Nuhn, Stratford (CA)

( * ) Notice: Subject to any disclaimer, the term of this patent is extended or adjusted under 35 U.S.C. 154(b) by 483 days.

(21) Appl. No.: 18/446,316

(22) Filed: Aug. 8, 2023

(65) Prior Publication Data

US 2024/0018964 A1 Jan. 18, 2024

Related U.S. Application Data

(63) Continuation-in-part of application No. 17/859,479, filed on Jul. 7, 2022.

(60) Provisional application No. 63/219,621, filed on Jul. 8, 2021.

(51) Int. Cl.

| | |
|---|---|
| ***E02F 3/88*** | (2006.01) |
| ***E02F 3/38*** | (2006.01) |
| ***E02F 9/08*** | (2006.01) |

(52) U.S. Cl.

CPC ..... *E02F 3/8825* (2013.01); *E02F 3/384* (2013.01); *E02F 9/0858* (2013.01)

(58) Field of Classification Search

CPC ..... E02F 3/8825; E02F 3/384; E02F 9/085; E02F 9/0858; Y10T 137/8807; E04G 21/04

See application file for complete search history.

(56) References Cited

U.S. PATENT DOCUMENTS 3,964,512 A * 6/1976 Dumas ..... F16L 3/16 406/166
4,519,768 A * 5/1985 Murai ..... E04G 21/0463 425/456
4,924,898 A * 5/1990 Evenson ..... E03F 7/10 417/244
5,311,682 A 5/1994 Sturdivant
6,401,829 B1 6/2002 Newton (Continued)

FOREIGN PATENT DOCUMENTS

SE 449679 5/1987

OTHER PUBLICATIONS

Brochure for Full Throttle Series Outlaw—Bazooka Farmstar Pump Unit.

(Continued)

*Primary Examiner* — Christopher J Sebesta
*Assistant Examiner* — Blake E Scoville
(74) *Attorney, Agent, or Firm* — Brunet & Co. Ltd.; Robert Brunet; Hans Koenig

(57) ABSTRACT

A liquid pumping vehicle has: a platform rotatably mounted on a frame; an articulated boom mounted on the platform; a first liquid pump mounted on the boom; a second liquid pump mounted on the platform on the engine-side, the second liquid pump in fluid connection with a fluid conduit through which the first liquid pump pumps the liquid, and an engine mounted on the platform, so that a rotation axis of the platform is between the boom and the engine and so that a weight of the engine, the second liquid pump and other components on an engine-side of the platform acts as a counterbalance to a weight of the boom and other components on a boom-side of the platform; and. The vehicle is better balanced for greater stability when in use for pumping a liquid, e.g., liquid manure.

26 Claims, 24 Drawing Sheets

(56) References Cited

U.S. PATENT DOCUMENTS

| | | | | |
|---|---|---|---|---|
| 6,698,451 | B2 | 3/2004 | Anderson et al. | |
| 7,762,271 | B2 * | 7/2010 | Funk | E04G 21/0436 137/1 |
| 8,979,125 | B2 * | 3/2015 | Sato | E02F 9/18 180/196 |
| 11,678,603 | B2 | 6/2023 | Bambauer et al. | |
| 2013/0343853 | A1 | 12/2013 | Sato et al. | |
| 2014/0338233 | A1 | 11/2014 | Albers et al. | |
| 2015/0321594 | A1 * | 11/2015 | Harms, Jr. | E02F 3/8816 406/40 |
| 2019/0134440 | A1 | 5/2019 | Carter | |
| 2020/0344945 | A1 * | 11/2020 | Bambauer | B62D 63/08 |

OTHER PUBLICATIONS

Office Action dated May 20, 2025 on U.S. Appl. No. 17/859,479.
USPTO Office Action Nov. 12, 2025.

* cited by examiner

BOOM MOUNTED PUMP

CROSS-REFERENCE TO RELATED APPLICATIONS

This application is a continuation-in-part of U.S. patent application Ser. No. 17/859,479 filed Jul. 7, 2022, which claims the benefit of U.S. patent application 63/219,621 filed Jul. 8, 2021, both of which are incorporated herein by reference.

FIELD

This application relates to liquid pumps and vehicles equipped for pumping. In particular, this application relates to boom mounted pumps.

BACKGROUND

Liquid manure comprises a suspension of solid manure in a liquid medium (i.e., water). Liquid manure is often stored in a large lagoon for use later for fertilizing fields. When use of the stored liquid manure is desired, a pump immersed in the liquid manure lagoon is used to pump the liquid manure out of the lagoon into a tank of a liquid manure spreader.

Liquid manure lagoons are often very large and/or surrounded by a high wall or berm. Boom mounted pumps have been developed to assist in pumping liquid manure out of the lagoon into a tank of a liquid manure spreader. However, the ground around the liquid manure lagoons is usually unstable and/or sloped, therefore the vehicles on which the boom mounted pumps are supported are generally parked relatively far from the lagoon necessitating long booms, which severely destabilizes the vehicle. To better stabilize the vehicle, very long stabilizer legs must be used, which also limits the space in which the vehicle may be parked.

There remains a need for a boom mounted pump arrangement that has a smaller vehicle footprint and/or is more stable on unstable ground.

SUMMARY

In an embodiment, a liquid pumping vehicle comprises: a frame; rotatable ground-engaging elements mounted on the frame to permit driving the vehicle on ground; a platform rotatably mounted on the frame, the platform rotatable about a vertically oriented rotation axis relative to the ground; an articulated boom mounted on the platform proximate a first end of the boom; a liquid pump mounted on the boom proximate a second end of the boom, the liquid pump immersible in a liquid reservoir for pumping liquid out of the reservoir; an engine mounted on the platform, the engine operably connected to the liquid pump for operating the liquid pump, the engine situated so that the rotation axis of the platform is between the boom and the engine and so that a first turning moment created on a first moment arm relative to the rotation axis by weight of the engine and other components on an engine-side of the platform is balanced under operational conditions of the pumping vehicle by a second turning moment created on a second moment arm relative to the rotation axis by weight of the boom and other components on a boom-side of the platform; and, a flow discharge outlet mounted on the frame, the flow discharge outlet connected to the liquid pump by a fluid conduit through which the liquid is pumped by the liquid pump from the liquid reservoir to the flow discharge outlet.

In another embodiment, a liquid pumping vehicle comprises: a frame; rotatable ground-engaging elements mounted on the frame to permit driving the vehicle on ground; a platform rotatably mounted on the frame, the platform rotatable about a vertically oriented rotation axis relative to the ground; an articulated boom mounted on the platform proximate a first end of the boom; a first liquid pump mounted on the boom proximate a second end of the boom, the liquid pump immersible in a liquid reservoir for pumping liquid out of the reservoir; a second liquid pump mounted on the platform, the second liquid pump in fluid connection with a fluid conduit through which the first liquid pump pumps the liquid; an engine mounted on the platform, the engine operably connected to the liquid pump for operating the liquid pump, the engine situated so that the rotation axis of the platform is between the boom and the engine and so that a weight of the engine, second liquid pump and other components on an engine-side of the platform acts as a counterbalance to a weight of the boom and other components on a boom-side of the platform; and, a flow discharge outlet, the flow discharge outlet connected to the second liquid pump by the fluid conduit through which the liquid is pumped by the first and second liquid pumps from the liquid reservoir to the flow discharge outlet.

The vehicle is better balanced for greater stability on unstable ground when in use for pumping a liquid. The balance is a major factor, since less weight is placed on stabilizer legs. The greater stability thereby permits the use of shorter stabilizer legs, resulting in the vehicle having a smaller footprint, which is especially useful in areas where there is not much space. The presence of a second liquid pump mounted on the engine-side of the platform provides more counterweight for the boom thereby permitting the use of longer booms. The second liquid pump cooperates with the first liquid pump for more efficient pumping of the liquid.

In some embodiments, the platform is continuously rotatable through 360°, preferably in both rotational directions. In some embodiments, the engine and the boom are fixedly mounted on the platform to be carried by the platform as the platform is being rotated while maintaining the balance of the first turning moment and the second turning moment. Maintaining the balance of the first turning moment and the second turning moment ensures that the center of gravity of the trailer remains over the frame of the trailer, preferably on or close to the rotation axis of the platform. Thus, the engine, and a hydraulic fluid pump when present, acts as a counterbalance to the boom, which permits the use of a shorter overall boom length because there is more useable boom length in the present arrangement, while the inclusion of the second liquid pump permits the use of a longer boom while maximizing efficiency of the overall boom length. To further maximize efficiency of the overall boom length, articulation points of the boom permit pivoting of boom arm sections through 180°. Balance is maintained under operation conditions of the pumping vehicle, which may comprise one or more of, preferably all of, the hydraulic fluid lines being full of hydraulic fluid, the boom being extended and the fluid conduit containing liquid being pumped by the liquid pump.

Such an arrangement further permits continuous positioning of the boom and the liquid pump at the end of the boom without the necessity of pivoting hydraulic fluid lines through a swivel. The only swivel (i.e., rotation) point is where the platform is mounted on the trailer. The entire platform swivels. The engine, and a hydraulic fluid pump when present, are on an engine-side of the rotation axis of the platform. The hydraulic pump, when present, is driven by the engine, the hydraulic pump operatively connected to the first liquid pump for operating the first liquid pump. The first liquid pump preferably comprises a hydraulic motor for operating the first liquid pump, in which case the hydraulic motor may be operatively connected to the hydraulic pump by hydraulic fluid lines extending between the hydraulic fluid pump and the hydraulic motor along the boom. The second liquid pump is preferably driven by a drive shaft of the engine, for example driven directly or through a clutching mechanism. The second liquid pump preferably operates at higher pressure than the first liquid pump.

The boom is connected to the platform on a boom-side of the rotation axis, preferably directly opposite the engine and the second liquid pump, and opposite the hydraulic fluid pump when present. When the platform pivots about the rotation axis, the boom, with the first liquid pump thereon, the second liquid pump on the platform and the engine, with the hydraulic fluid pump connected thereto, all swivel at the same time in the same direction at the same rate, eliminating the need for swiveling of hydraulic fluid lines connected to the hydraulic pump and the first liquid pump. The hydraulic fluid lines themselves are only required to flex about the joints of the boom, not individually and/or separately swivel (i.e., not individually and/or separately rotate about a longitudinal axis of the hydraulic fluid line). High pressure hydraulic swivels are very difficult to make and a main failure point of hydraulically powered equipment. The arrangement described herein eliminates the need for such swivels, increasing reliability and reducing the likelihood of an environmental disaster in the event of a hydraulic swivel failure.

In some embodiments, the vehicle may further comprise stabilizer legs mounted on the frame. The stabilizer legs are preferably moveable between a ground-disengaging position and a ground-engaging position. The stabilizer legs assist with stabilizing the vehicle on the ground when the stabilizer legs are in the ground-engaging position. Preferably, the stabilizer legs are pivotable on the frame between a lowered the ground-engaging position and a raised ground-disengaging position. Because of the stability provided by the platform arrangement, the stabilizer legs can be shorter thereby providing a smaller footprint for the vehicle, which permits use in space-restricted areas.

In some embodiments, the fluid conduit is at least partially housed in the boom between the first liquid pump and the flow discharge outlet. Also, in some embodiments, the fluid conduit is at least partially housed in the frame between the boom and the flow discharge outlet. Housing the fluid conduit in the boom and/or the frame protects the fluid conduit from damage, such as punctures and tears, which could occur when exposed portions of the fluid conduit get caught on obstacles or protruding parts of the vehicle. In other embodiment, the fluid conduit is situated exterior to the boom and passes from one side of the boom to another side of the boom at articulation points on the boom, thereby permitting the use of hard, difficult to puncture conduit materials such as hard steel.

In some embodiments, the articulated boom comprises at least two boom sections. The at least two boom sections are pivotable relative to each other by one or more hydraulic cylinders connected between adjacent boom sections. The boom may comprise two, three, four, five or more boom sections. Hydraulic cylinders connecting adjacent boom sections may be provided with hydraulic fluid from the same hydraulic pump that operates the first liquid pump, or by one or more dedicated hydraulic pumps. Hydraulic fluid may be provided from one or more hydraulic fluid reservoirs, which hold hydraulic fluid to be used to operate any or all of the hydraulic devices on the trailer. Preferably, there is one hydraulic fluid reservoir and one hydraulic fluid pump to provide hydraulic fluid to all hydraulic devices on the trailer. The hydraulic fluid pump is preferably a direct-drive hydraulic fluid pump. The hydraulic fluid pump is preferably a high-pressure pump instead of a high-volume pump. Appropriate valving may be provided to ensure proper operation of all of the hydraulic devices.

The vehicle can be used to pump any liquid (e.g., water, liquid manure, chemical solutions) from a reservoir (e.g., fire hydrants connected to water mains, rivers, lakes, ponds, liquid manure lagoons, storage tanks or the like). The vehicle can therefore be used in a variety of applications such as liquid manure transfer, fire-fighting, de-watering, chemical solution transfer and the like.

The vehicle may be a self-propelled vehicle or a trailer. The rotatable ground-engaging elements may comprise wheels, tracks or the like or combinations thereof.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
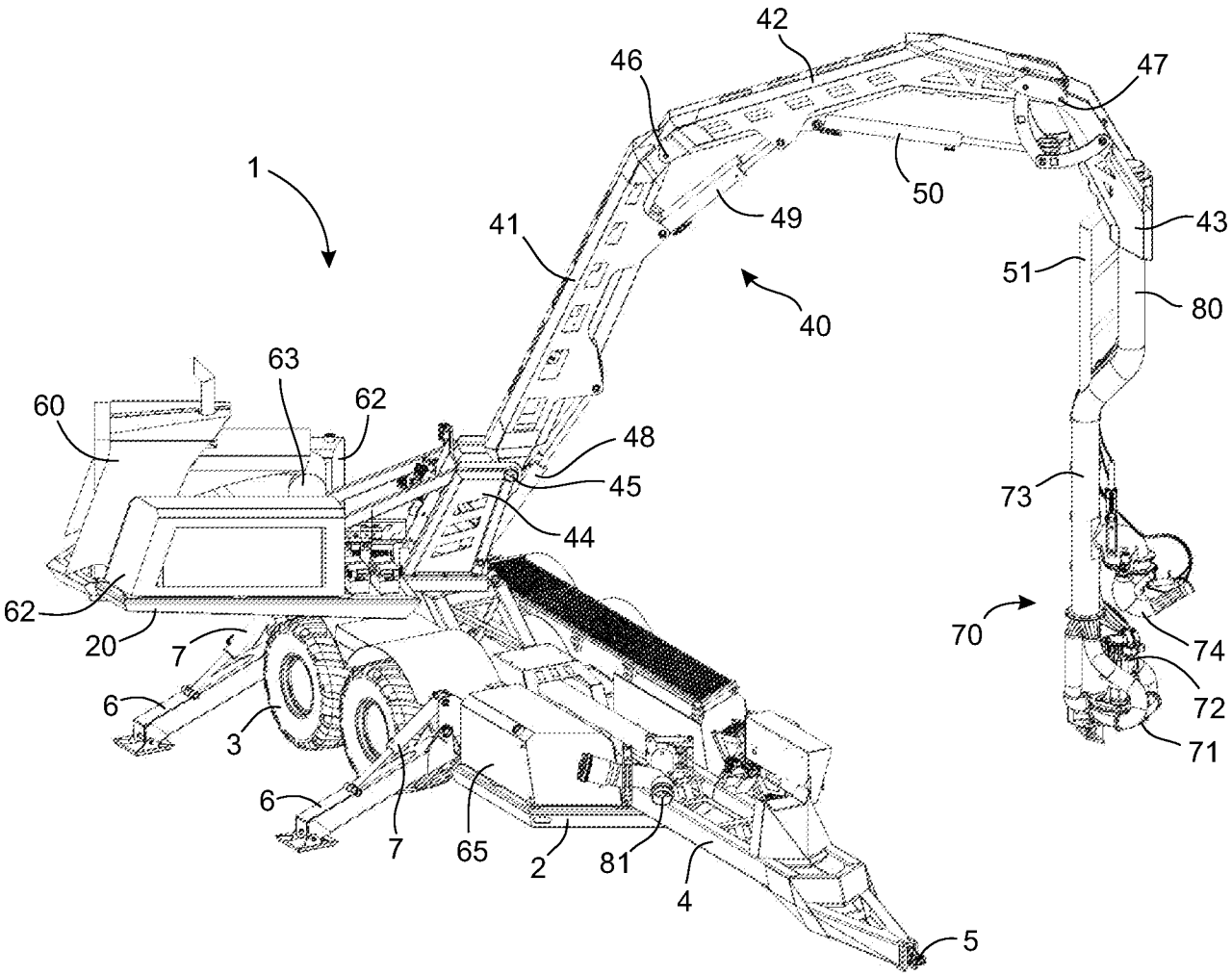
FIG. 1 depicts a front perspective view of a liquid pumping trailer with a boom extended in a first direction.
Figure 2:
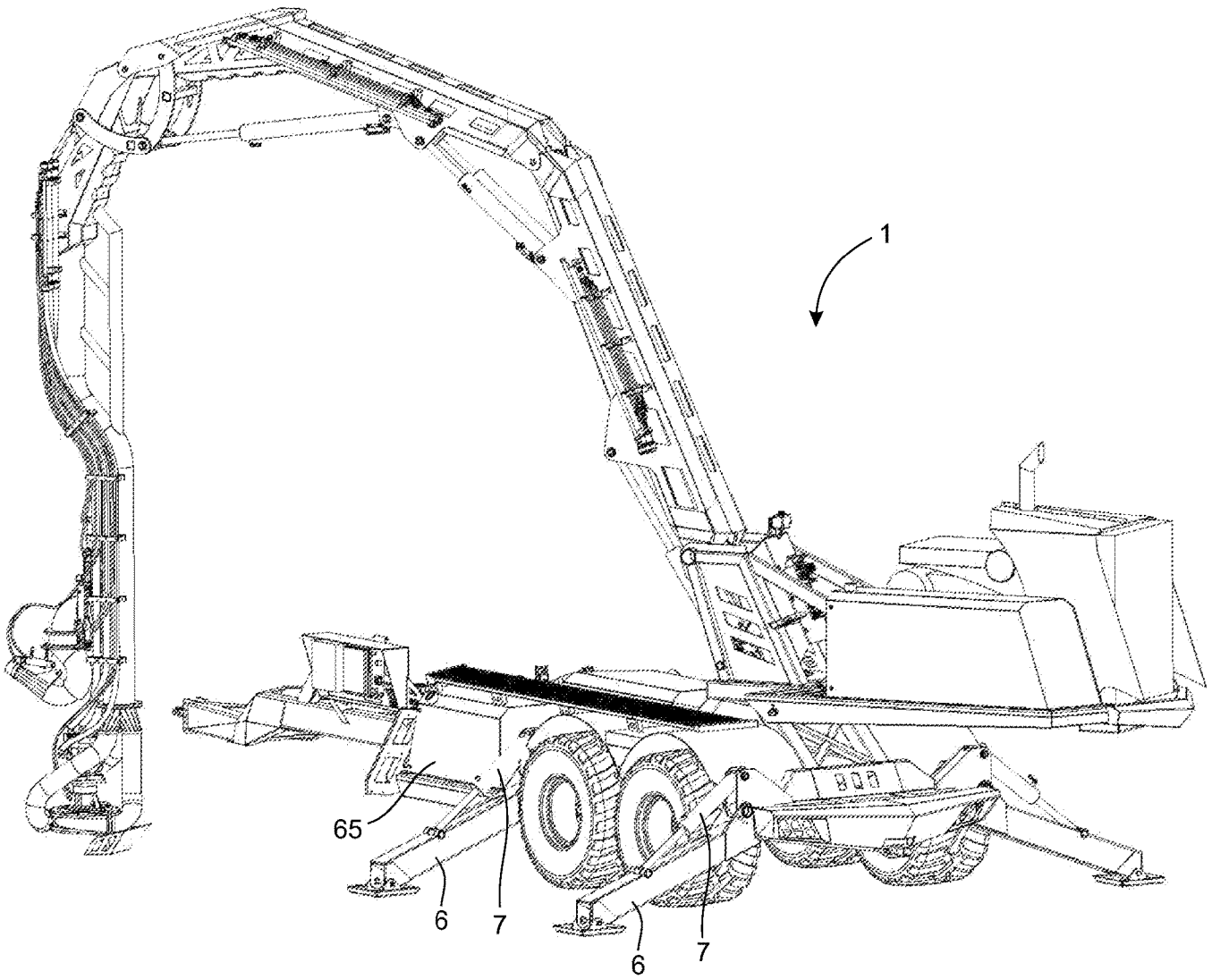
FIG. 2 depicts a rear perspective view of the trailer in FIG. 1.
Figure 3:
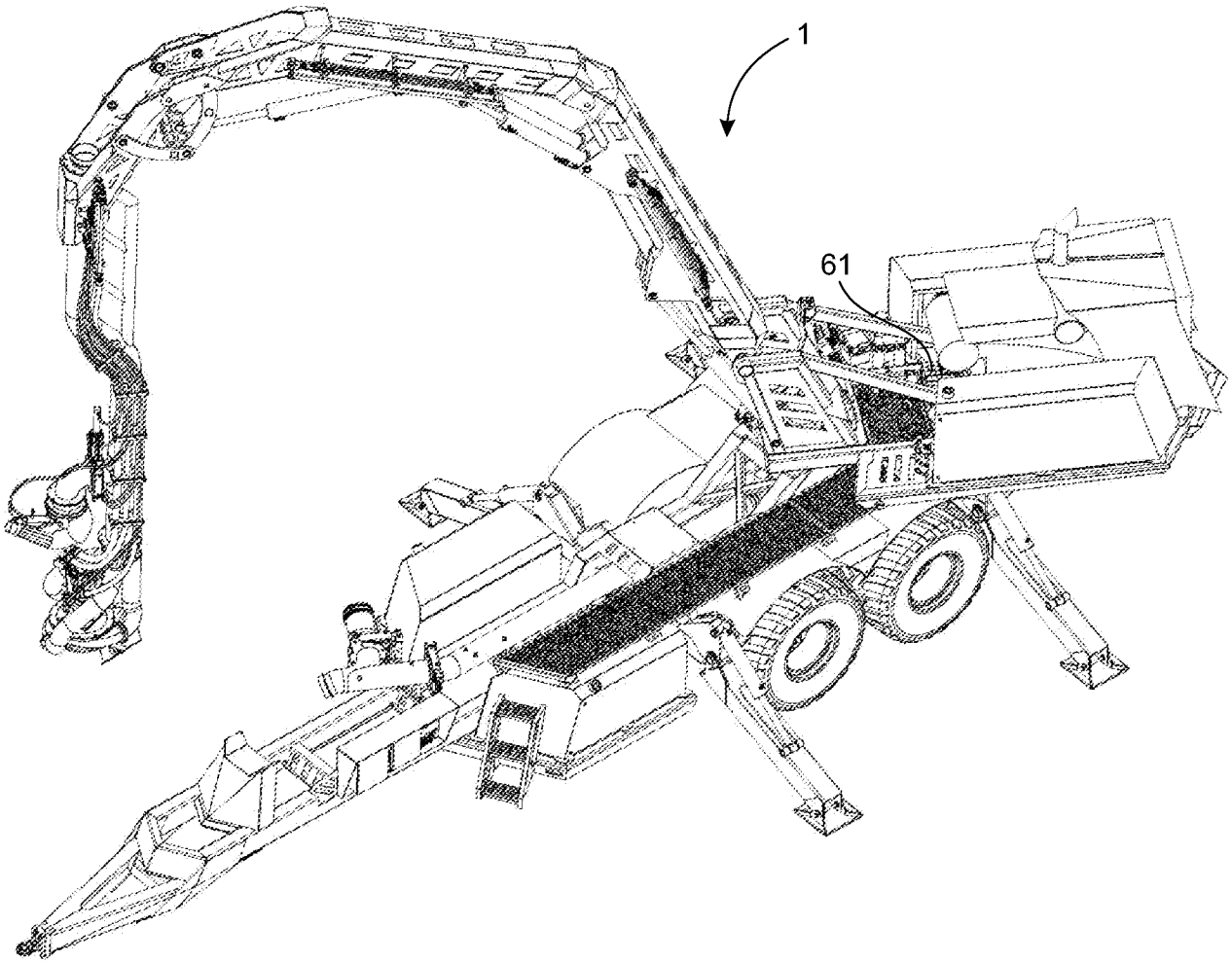
FIG. 3 depicts a front perspective view of the trailer of FIG. 1 with the boom extended in a second direction.
Figure 4:
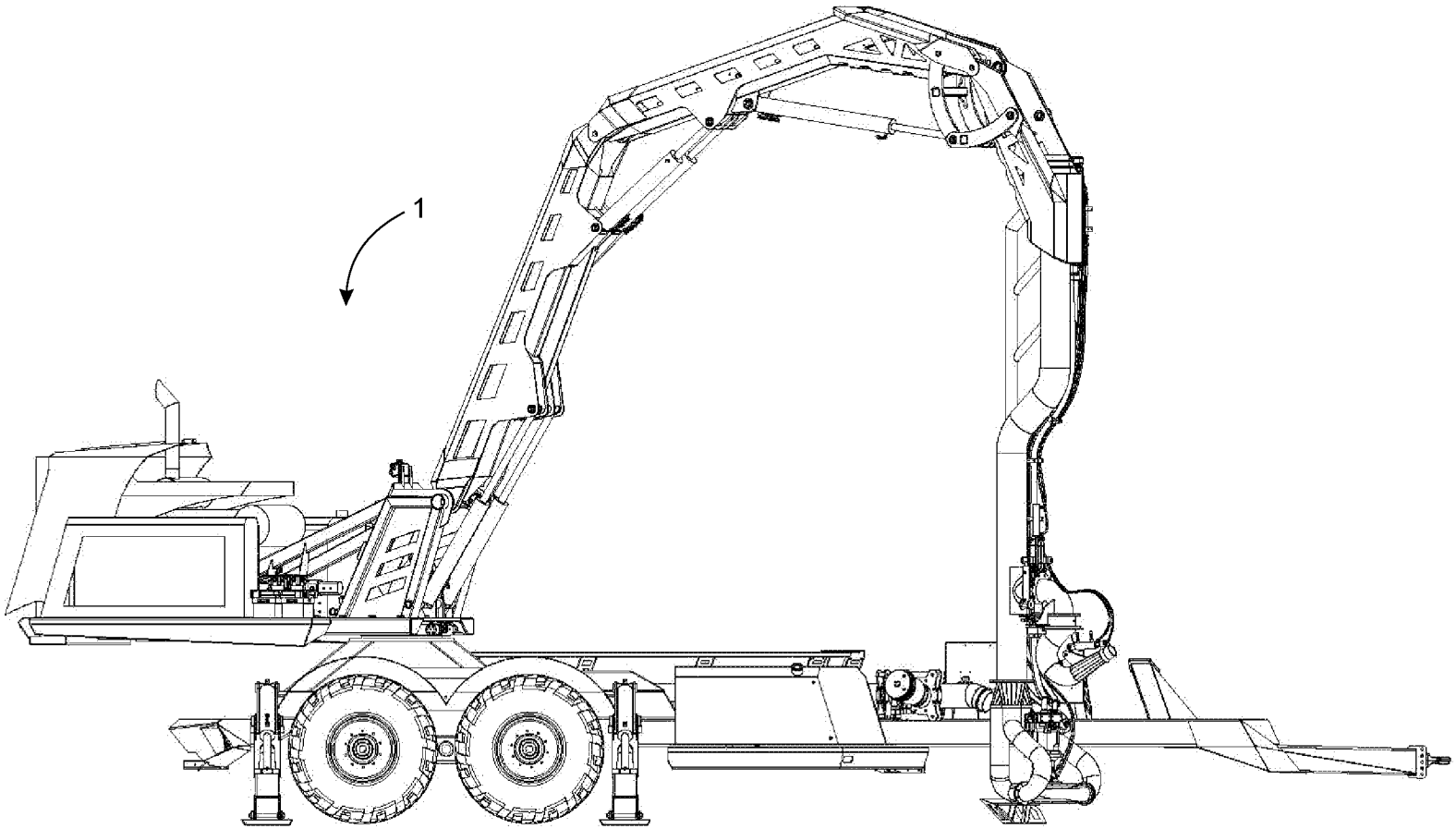
FIG. 4 depicts a side view of the trailer in FIG. 3.
Figure 5:
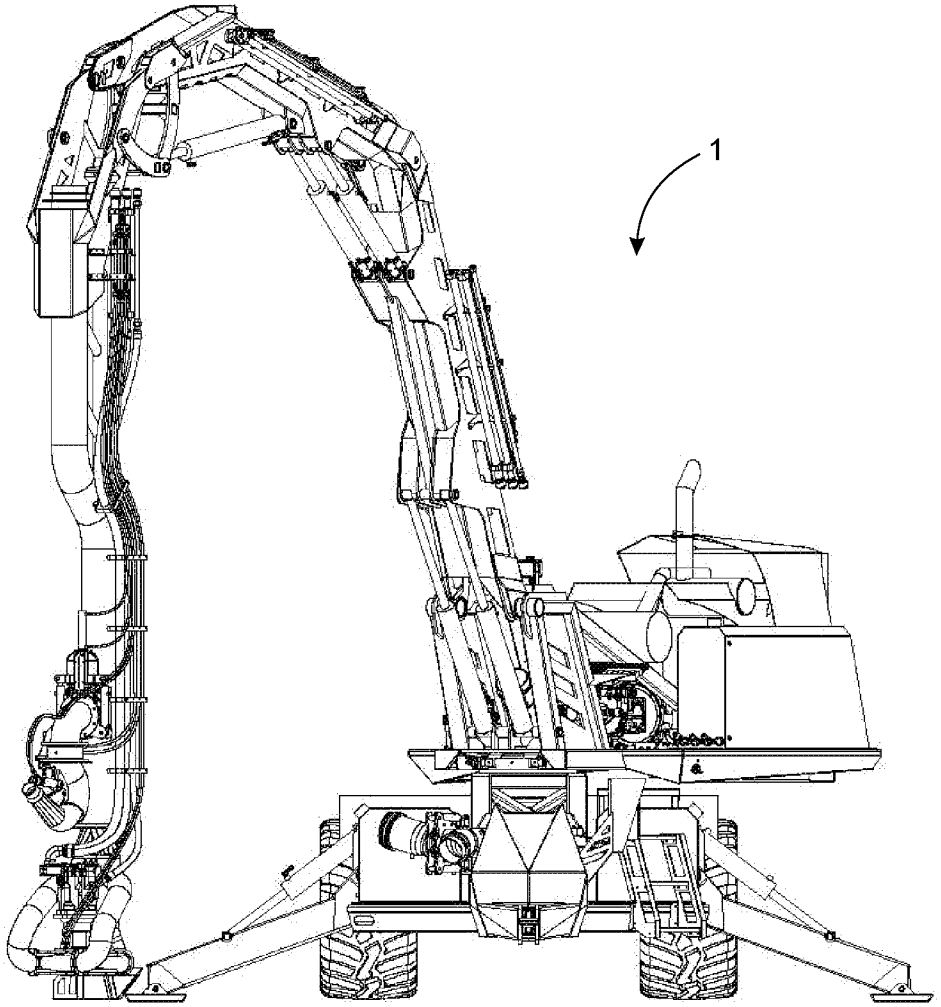
FIG. 5 depicts a front view of the trailer in FIG. 3.
Figure 6:
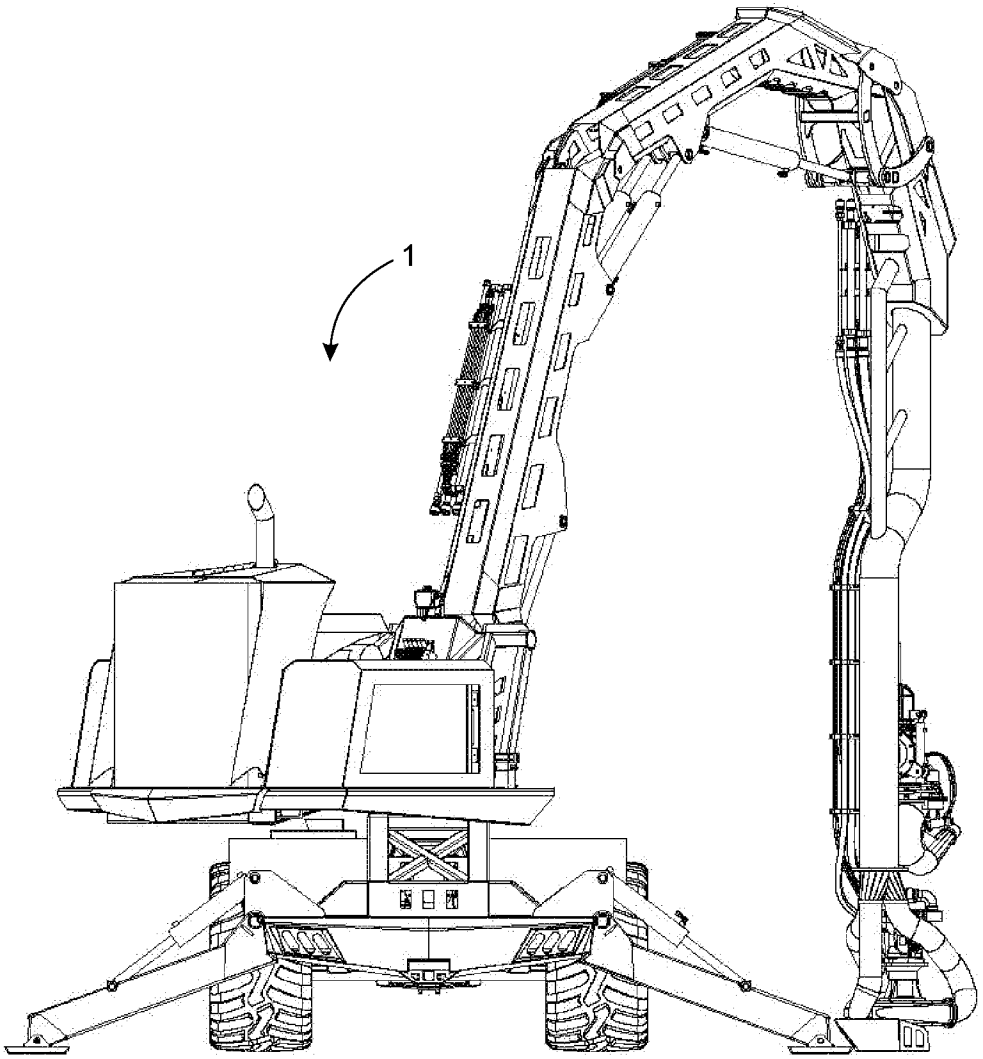
FIG. 6 depicts a rear view of the trailer in FIG. 3.
Figure 7:
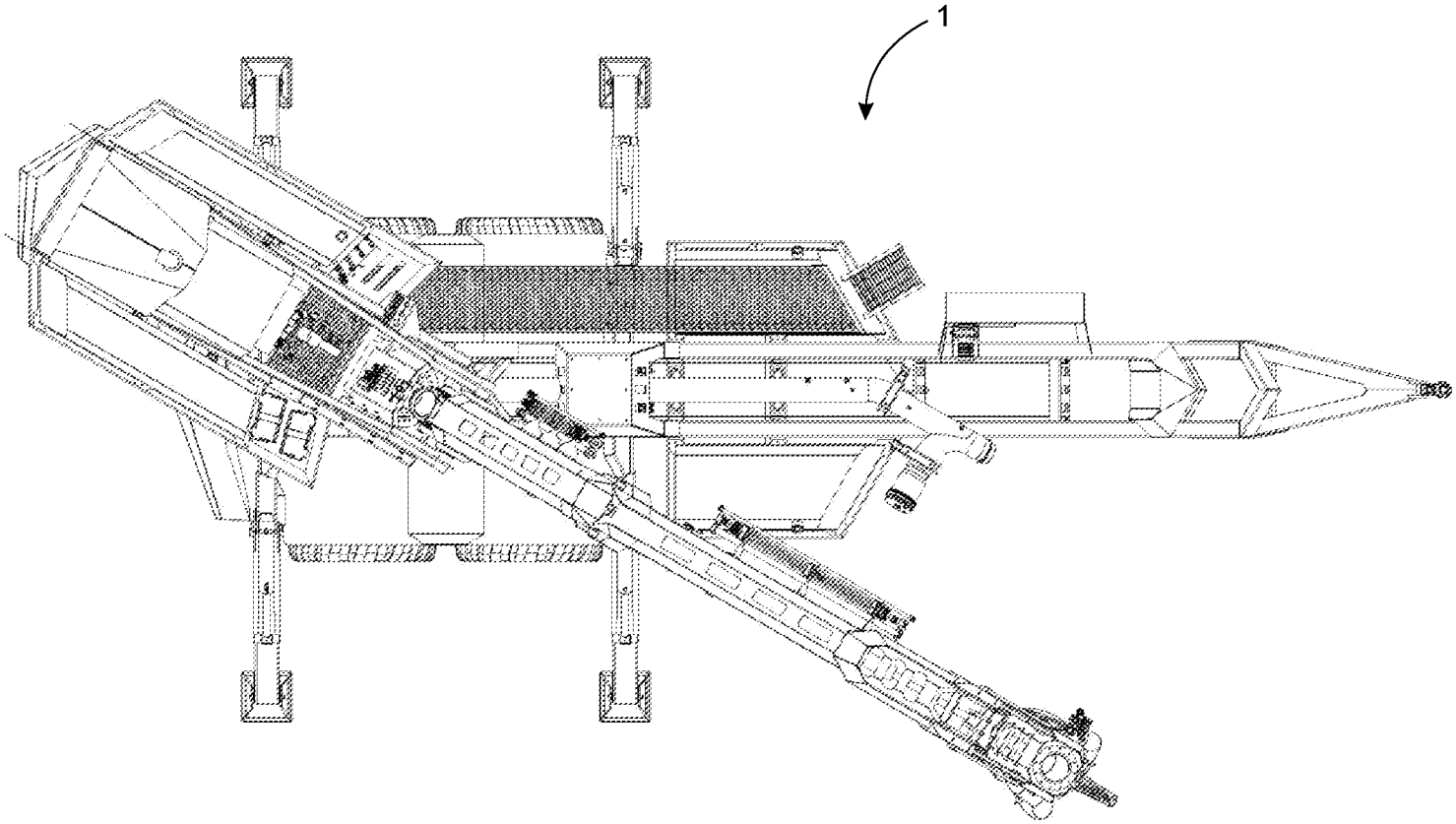
FIG. 7 depicts a top view of the trailer in FIG. 3.
Figure 8:
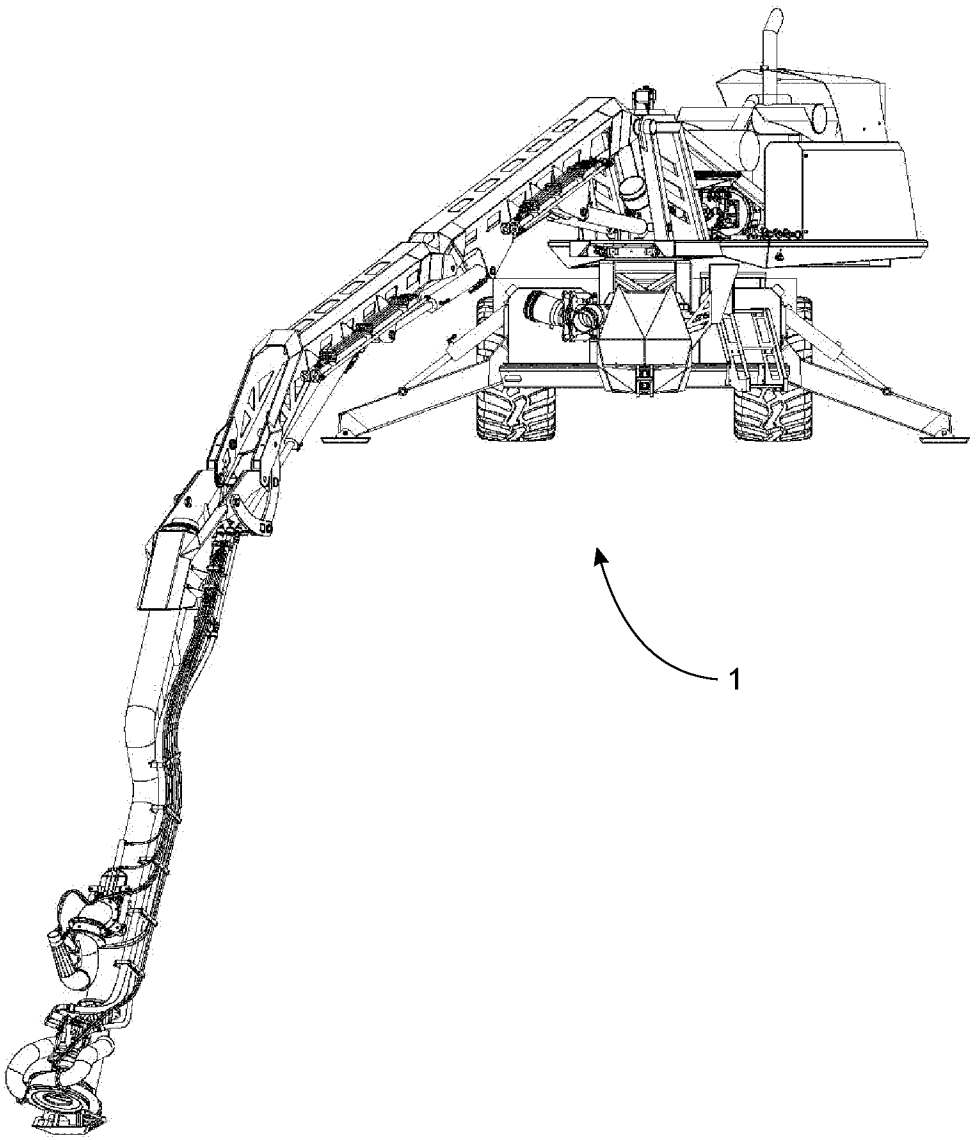
FIG. 8 depicts the trailer in FIG. 7 with the boom extended further.
Figure 9:
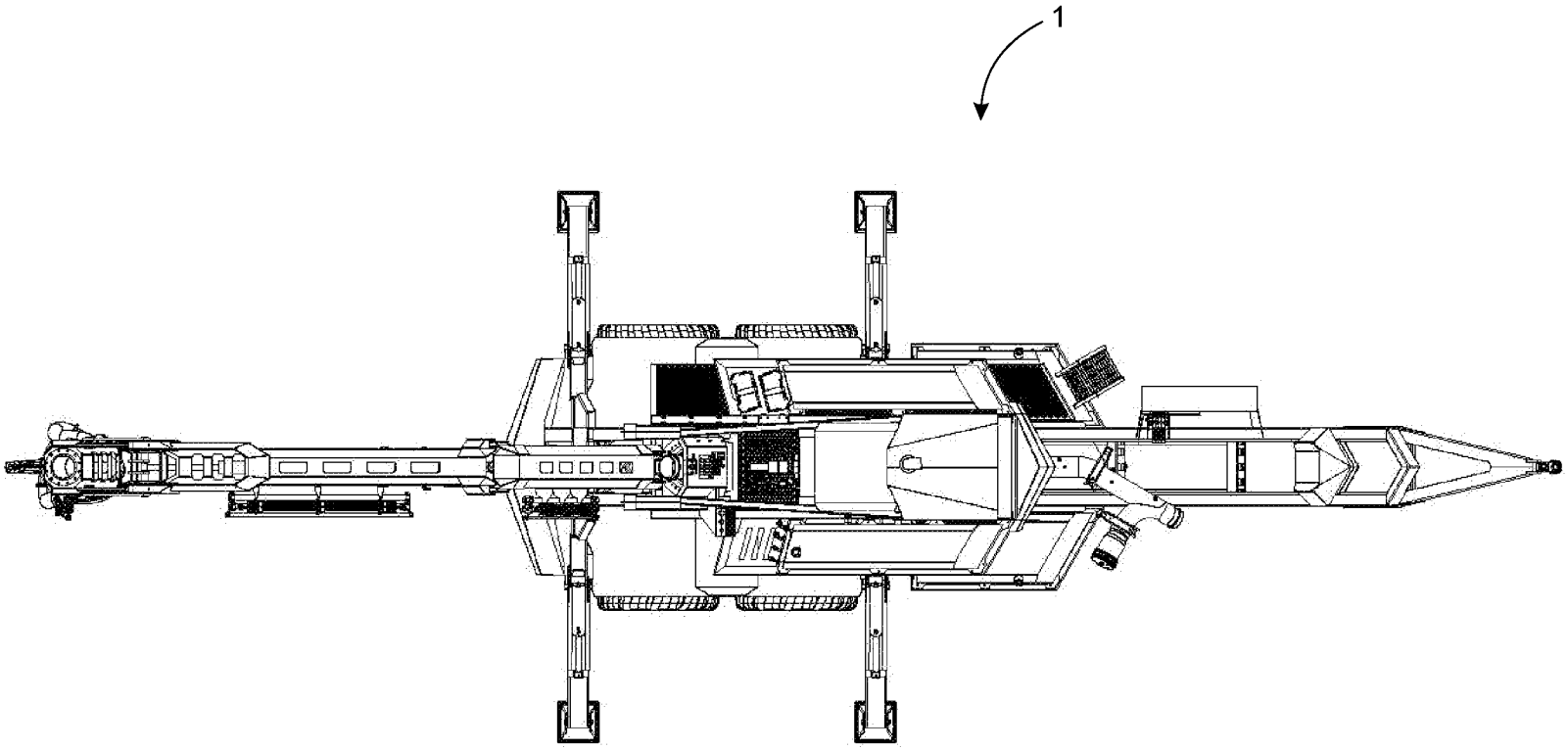
FIG. 9 depicts a top view of the trailer of FIG. 1 with the boom extended in a third direction.
Figure 10:
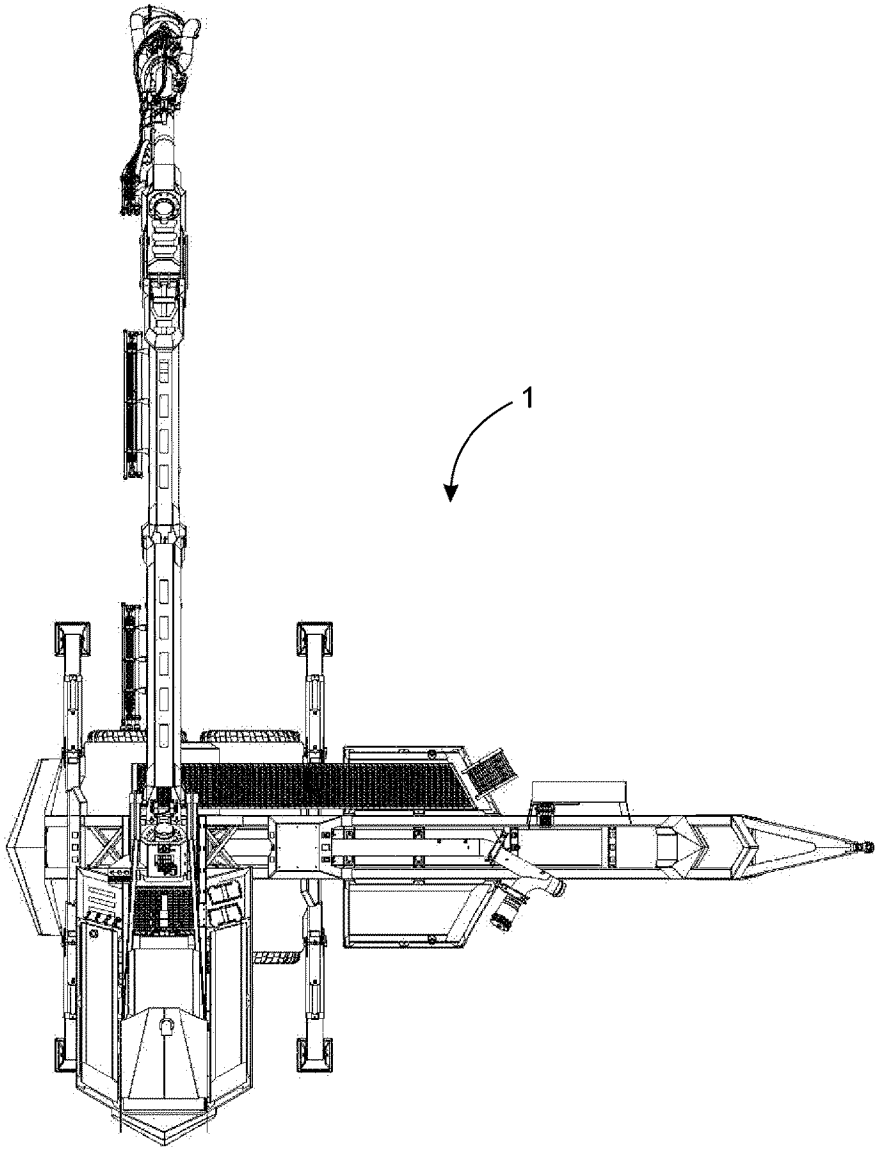
FIG. 10 depicts a top view of the trailer of FIG. 1 with the boom extended in a fourth direction.
Figure 11:
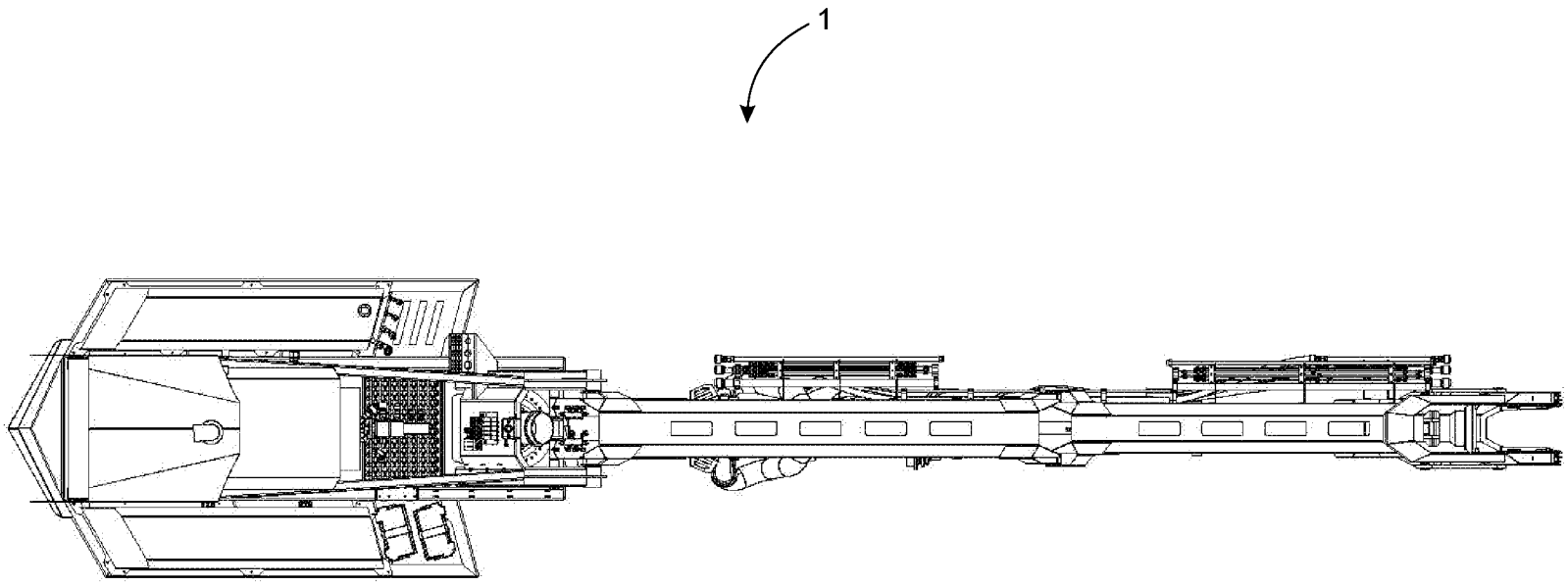
FIG. 11 depicts a top view of the trailer of FIG. 1 with the boom extended in a fifth direction.
Figure 12:
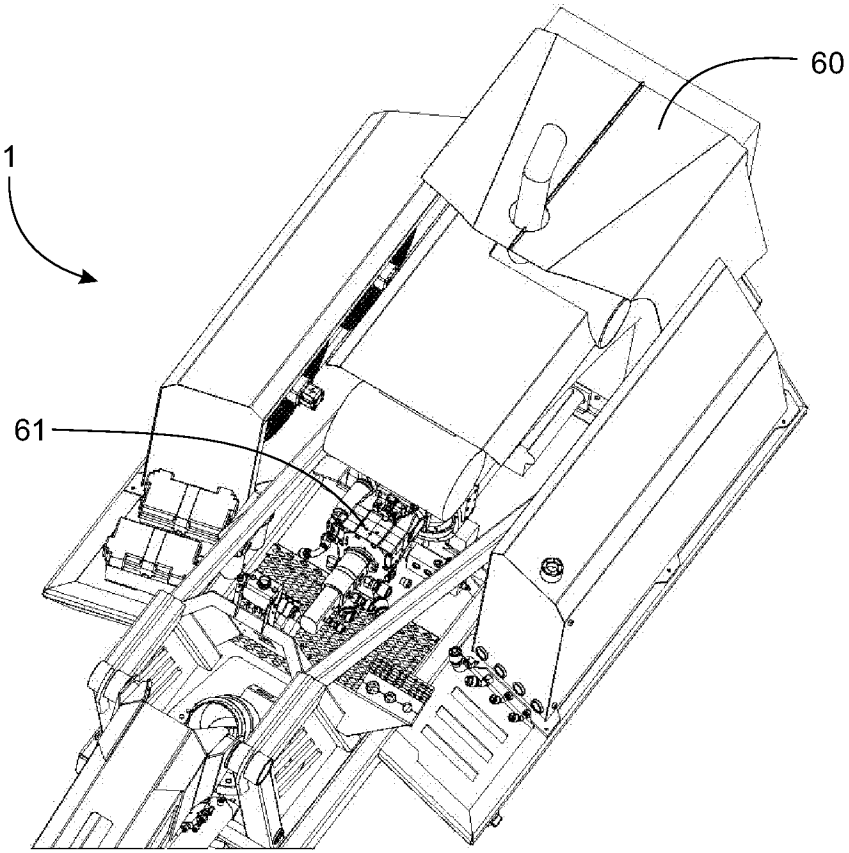
FIG. 12 depicts a magnified top perspective view of the trailer of FIG. 1 showing a location of a hydraulic pump on the trailer.

With reference to FIG. 1 to FIG. 15, an embodiment of a liquid pumping vehicle in the form of a liquid pumping trailer 1 is shown. The trailer 1 comprises a frame 2 on which are rotatably mounted four wheel 3 (only one labeled), two on each transverse side of the trailer 1 in a tandem axle configuration. The wheels may be other rotatable ground-engaging elements such as tracks or combinations of tracks and wheels. For example, two tracks, one on each transverse side of the trailer may be used instead of four wheels. Extending longitudinally forward from the frame 2 is a tongue 4 terminating in a hitch 5, which can be coupled to a prime mover (not shown) such as a truck, a tractor or other motorized vehicle. The trailer 1 further comprises four stabilizer legs 6 coupled to the frame 2, the stabilizer legs 6 moveable between raised stowed positions and lowered ground-engaging positions. The stabilizer legs 6 in the lowered ground-engaging positions serve to take some of the weight of the trailer 1 thereby stabilizing the trailer 1 during a pumping operation. The stabilizer legs 6 are pivotally connected to the frame 2 and are raised and lowered by operation of stabilizer leg actuators 7. The stabilizer leg actuators 7 may be any suitable actuator, for example hydraulic cylinders, pneumatic cylinders or linear actuators, but hydraulic cylinders are preferred.

Figure 13:
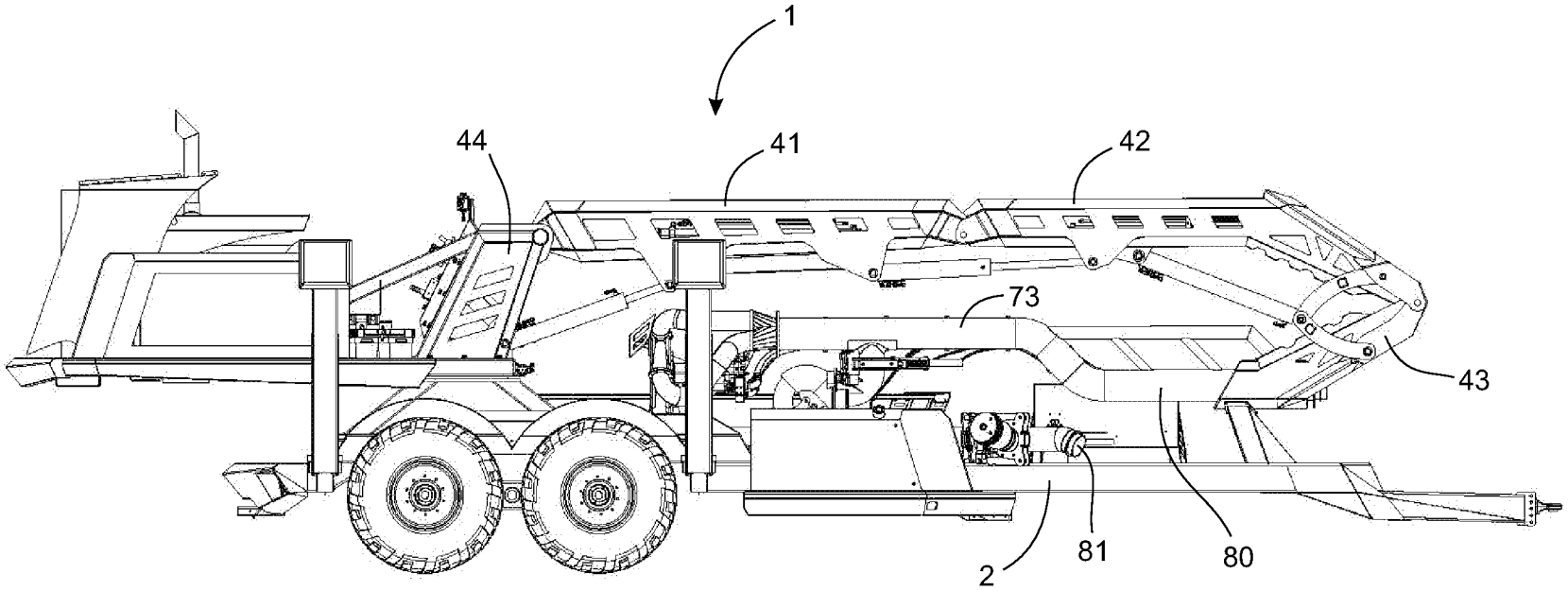
FIG. 13 depicts a side view of the trailer of FIG. 1 with the boom folded into a transport configuration.
Figure 14:
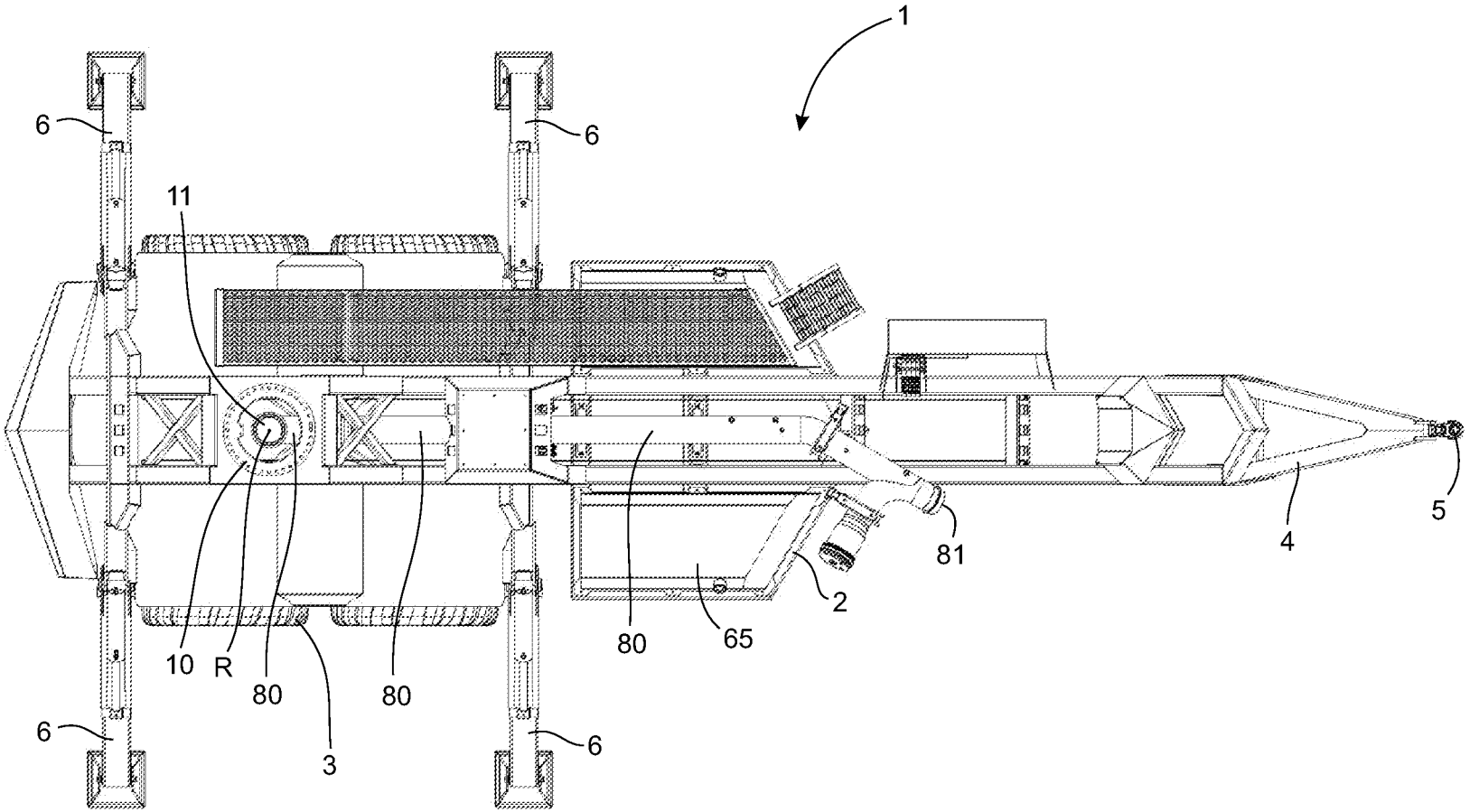
FIG. 14 depicts a top view of the trailer of FIG. 1 with the boom removed.

A hydraulic swivel 10 (see FIG. 14) is supported on the frame 2 over the axles of the wheels 3 so that most of the load placed on the swivel 10 is supported over the axles. The swivel 10 comprises a slewing bearing that is capable of continuous rotation in both rotational directions about a vertical rotation axis R through successive 360° rotations. Mounted on the swivel 10 is a platform 20. The platform 20 is mounted on the swivel 10 proximate a proximal end of the platform 20 so that as the platform 20 rotates with the swivel 10, a distal end of the platform 20 moves through an outer circular path. An articulated boom 40 having a first boom section 41, a second boom section 42 and third boom section 43 is mounted on the platform 20 through a boom mount 44. The boom mount 44 is rigidly secured to the platform 20 directly over the swivel 10. A proximal end of the first boom section 41 is pivotally connected to the boom mount 44 at pivot 45. A proximal end of the second boom section 42 is pivotally connected to a distal end of the first boom section 41 at pivot 46. A proximal end of the third boom section 43 is pivotally connected to a distal end of the second boom section at 42 at pivot 47. Pivoting of the boom sections 41, 42, 43 relative to each other is accomplished by actuating first, second and third boom section hydraulic cylinders 48, 49, 50. Actuation of the first boom section hydraulic cylinder 48 connected between the boom mount 44 and the first boom section 41 permits rotation of the first boom section 41 about pivot 45. Actuation of the second boom section hydraulic cylinder 49 connected between the first boom section 41 and the second boom section 42 permits rotation of the second boom section 42 about pivot 46. Actuation of the third boom section hydraulic cylinder 50 connected between the second boom section 42 and the third boom section 43 permits rotation of the third boom section 43 about pivot 47. Independent operation of the boom section hydraulic cylinders 48, 49, 50 permits extension and retraction of the boom 40 into a variety of configurations as evidenced by comparing the Figures, including folding the boom 40 into a folded transport configuration as seen in FIG. 13.

In operation, the boom 40 extends away from the platform 20 in a fixed direction relative to the platform 20. The length and height to which the boom 40 can reach is adjustable by operating the boom section hydraulic cylinders 48, 49, 50, but the radial orientation of the boom 40 relative to the frame 2 of the trailer 1 is only adjustable by rotating the entire platform 20.

To balance the weight of the boom 40 so that the center of gravity of the trailer 1 remains over the frame 2, an engine 60 and a hydraulic pump 61 (see FIG. 12), preferably a high-pressure direct-drive hydraulic pump, are fixedly mounted on the platform 20 on an engine-side of the platform 20 at or proximate the distal end of the platform 20 in a position opposite the boom 40 through the rotation axis R. Therefore, as the platform 20 is rotated, the boom 40 remains on a boom-side of the platform 20 opposite the engine 60 and the hydraulic pump 61 so that the engine 60 and the hydraulic pump 61 always act as a counterbalance to the boom 40 irrespective of the radial orientation of the boom 40. Such an opposed configuration is maintained at all times as the platform 20 is rotated through a full circle. Also mounted on the engine-side of the platform 20 are hydraulic fluid reservoirs 62 and a hydraulic fluid cooler 63, which are respectively used to supply hydraulic fluid to the hydraulic pump 61 and to cool the hydraulic fluid heated by operation of the hydraulic pump 61. The weights of the hydraulic fluid reservoir 62 and the hydraulic fluid cooler 63 also serve to counterbalance the boom 40. The hydraulic pump 61 drives a hydraulic motor of the hydraulic swivel 10, as well as driving other hydraulic components of the trailer 1.

Figure 15:
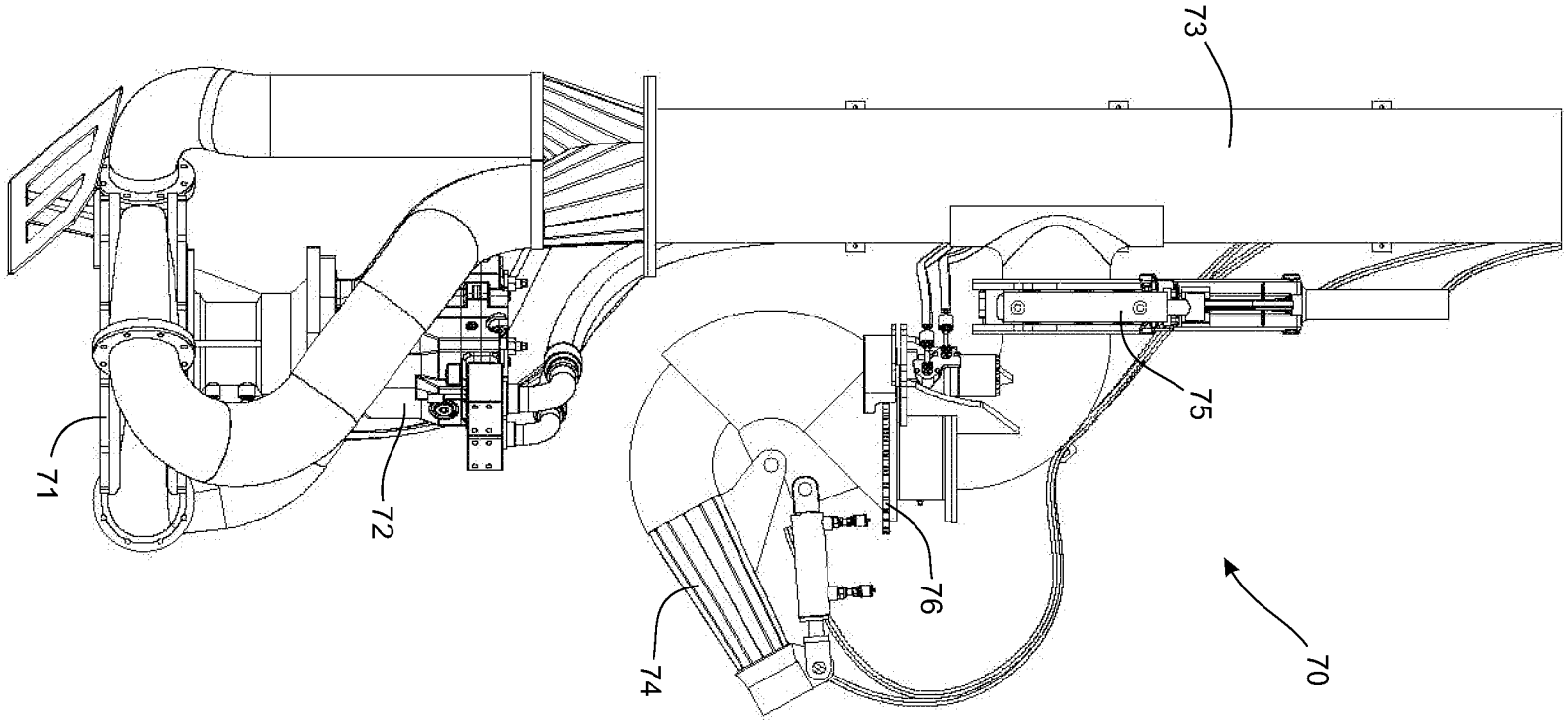
FIG. 15 depicts a magnified view of a liquid pump that is mounted at a distal end of the boom of the trailer of FIG. 1.
Figure 16:
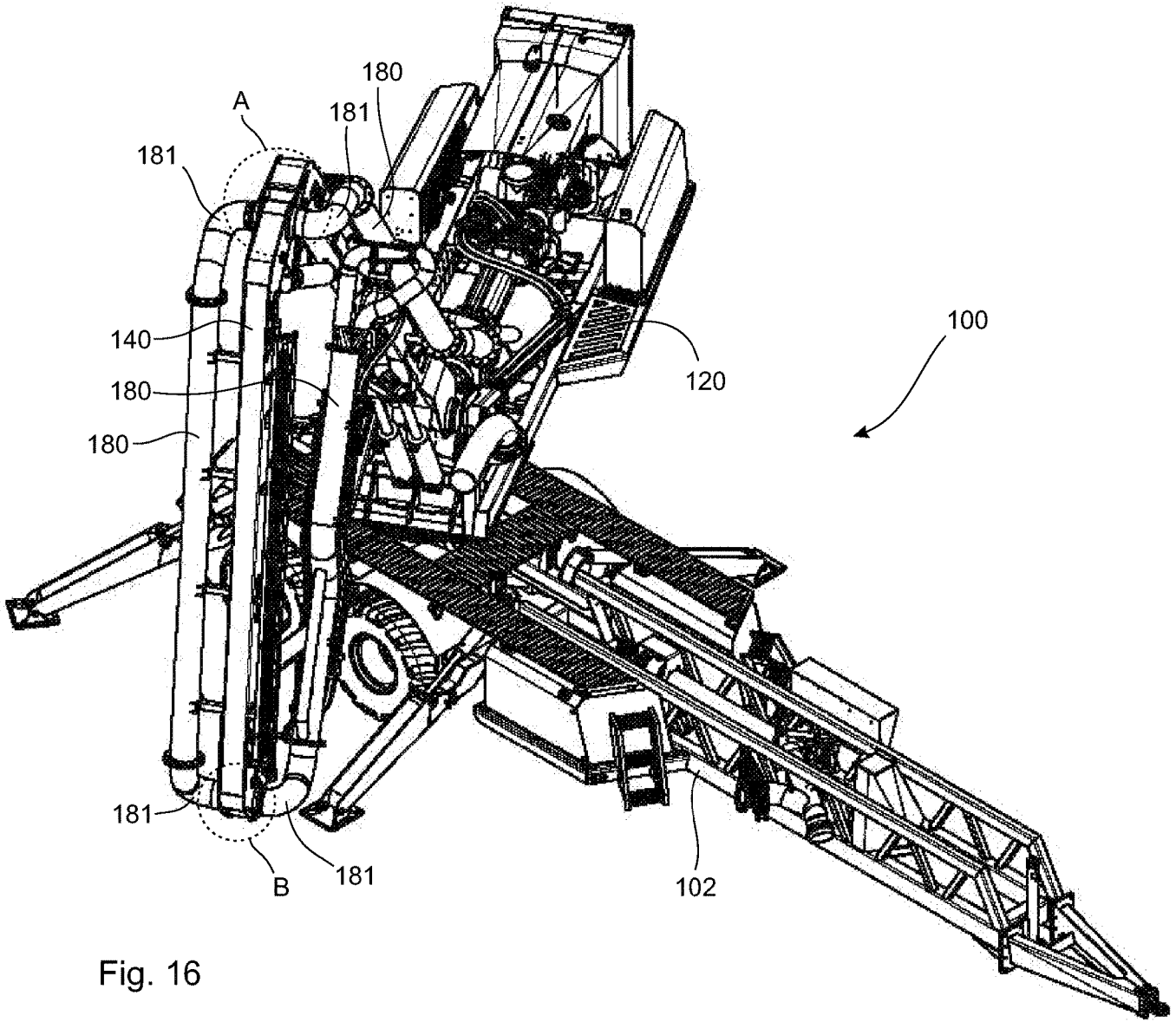
FIG. 16 depicts a front perspective view of another embodiment of a liquid pumping trailer with a boom partially folded.
Figure 17:
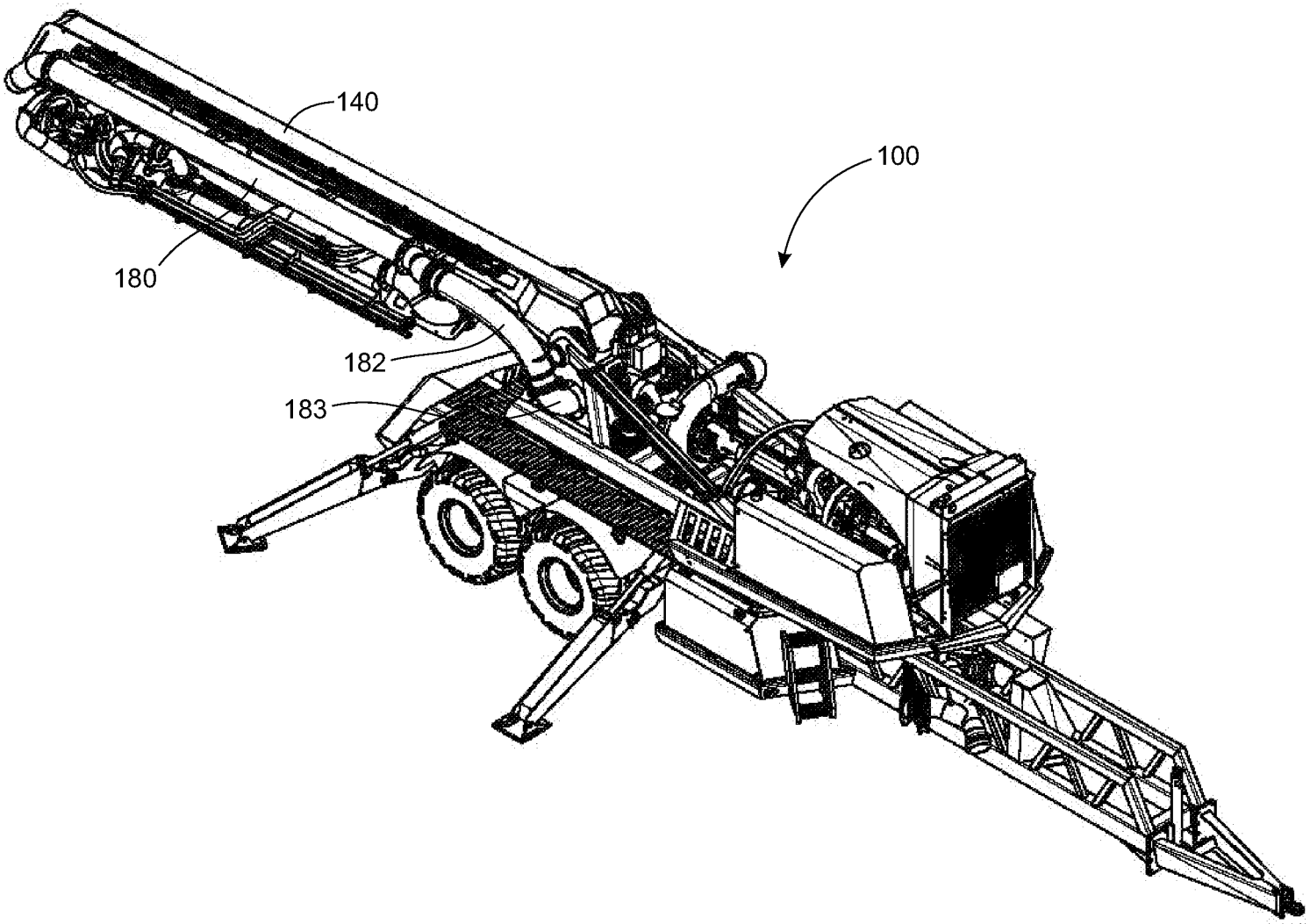
FIG. 17 depicts the trailer of FIG. 16 with the boom fully folded.
Figure 18:
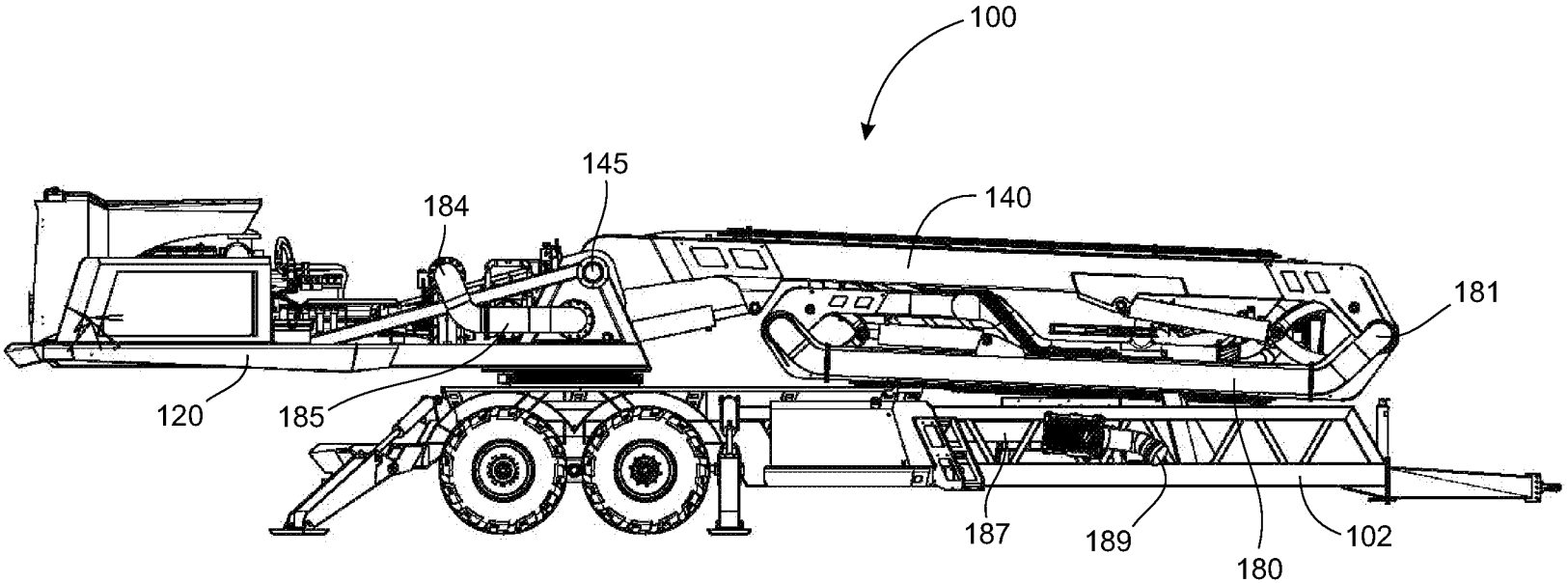
FIG. 18 depicts the trailer of FIG. 16 with the boom fully folded and in a transport configuration.
Figure 19:
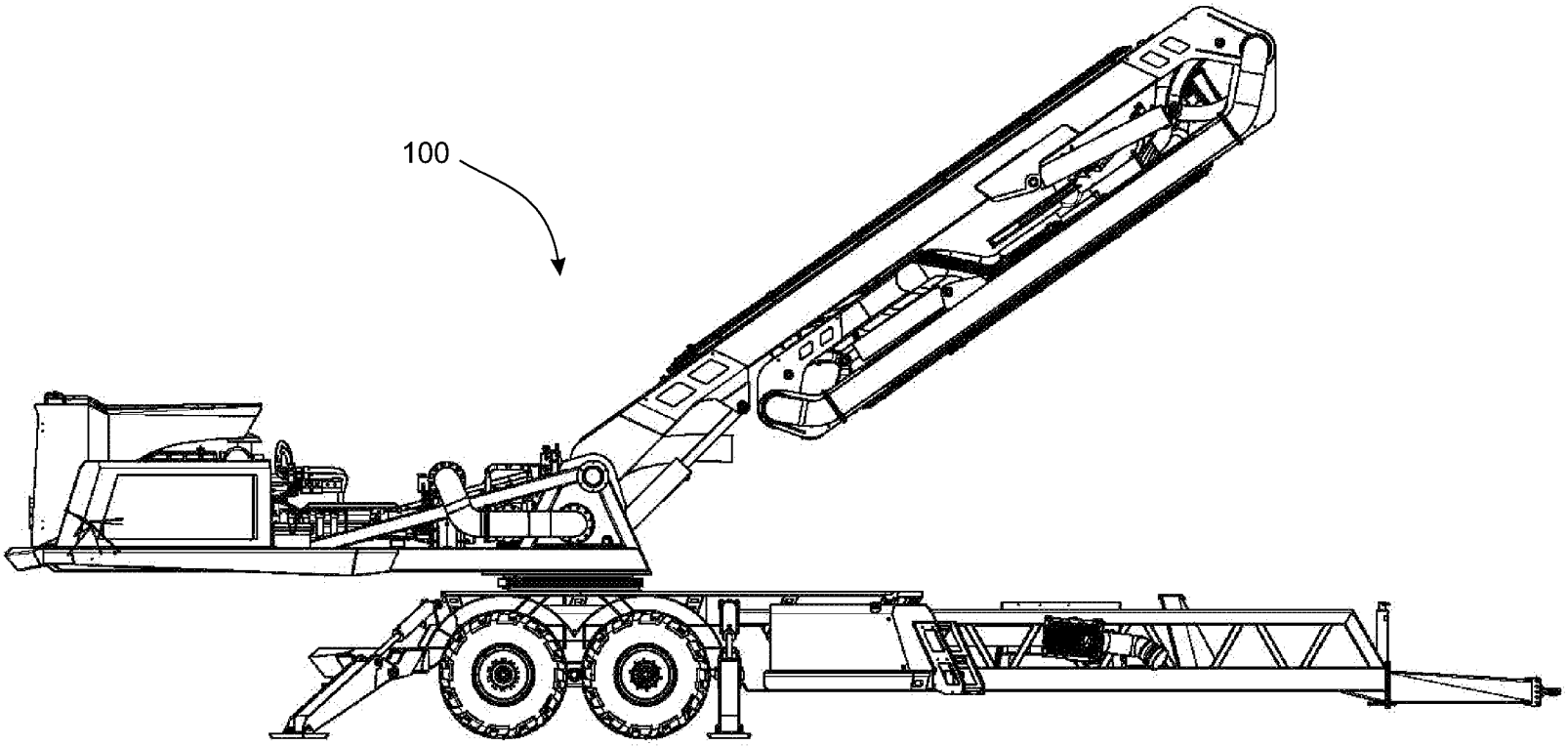
FIG. 19 depicts the trailer of FIG. 16 with the boom folded and raised out of the transport configuration.
Figure 20:
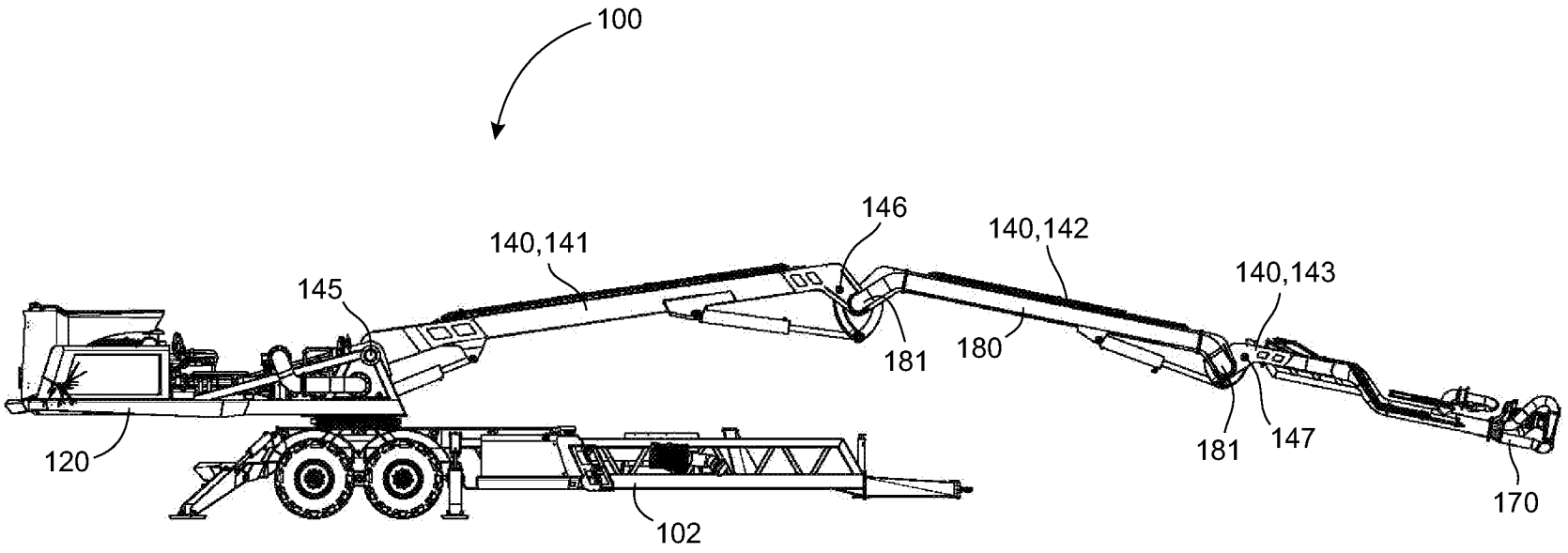
FIG. 20 depicts the trailer of FIG. 16 with the boom fully extended horizontally forward.
Figure 21:
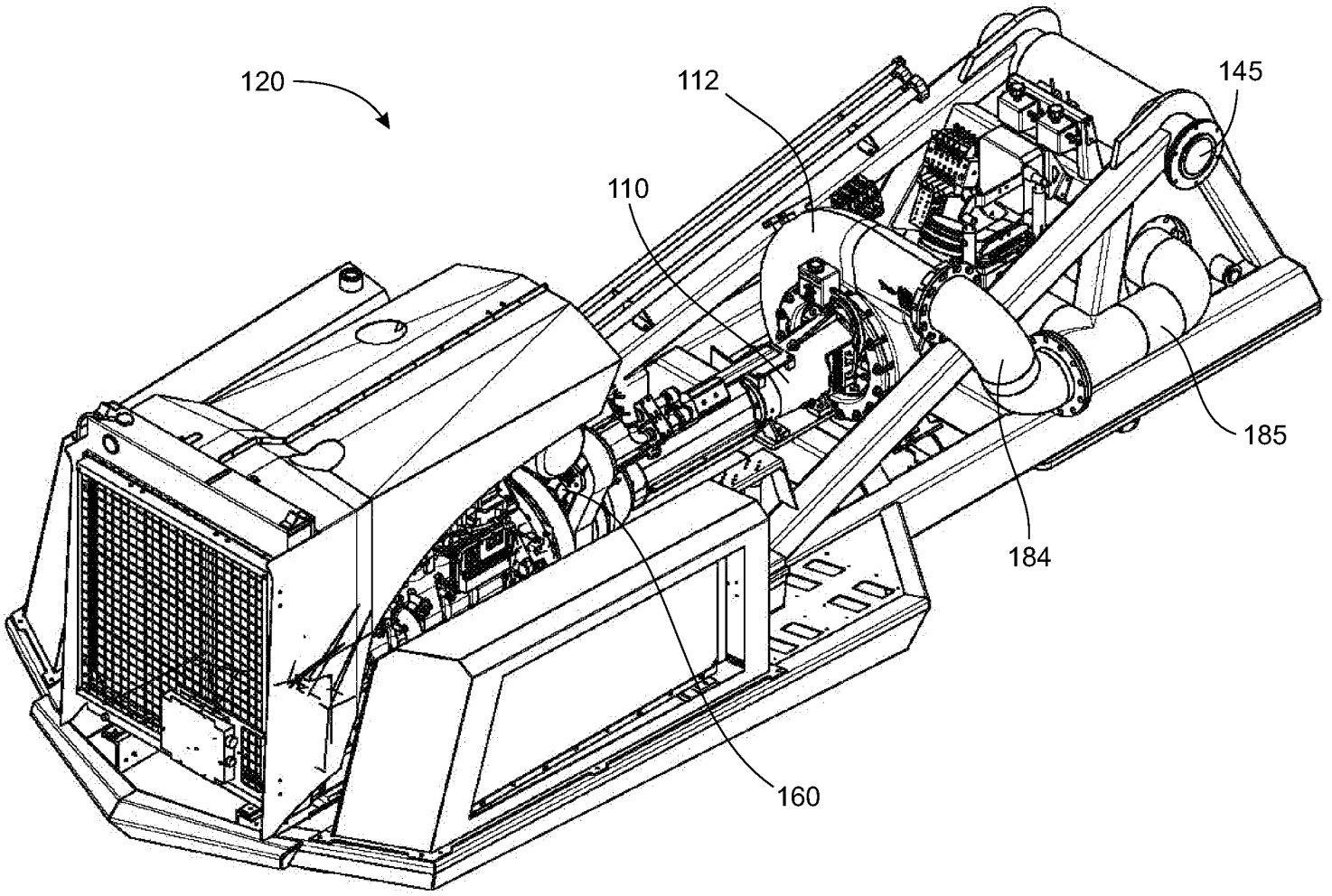
FIG. 21 depicts a top perspective view of a platform of the trailer of FIG. 16.
Figure 22:
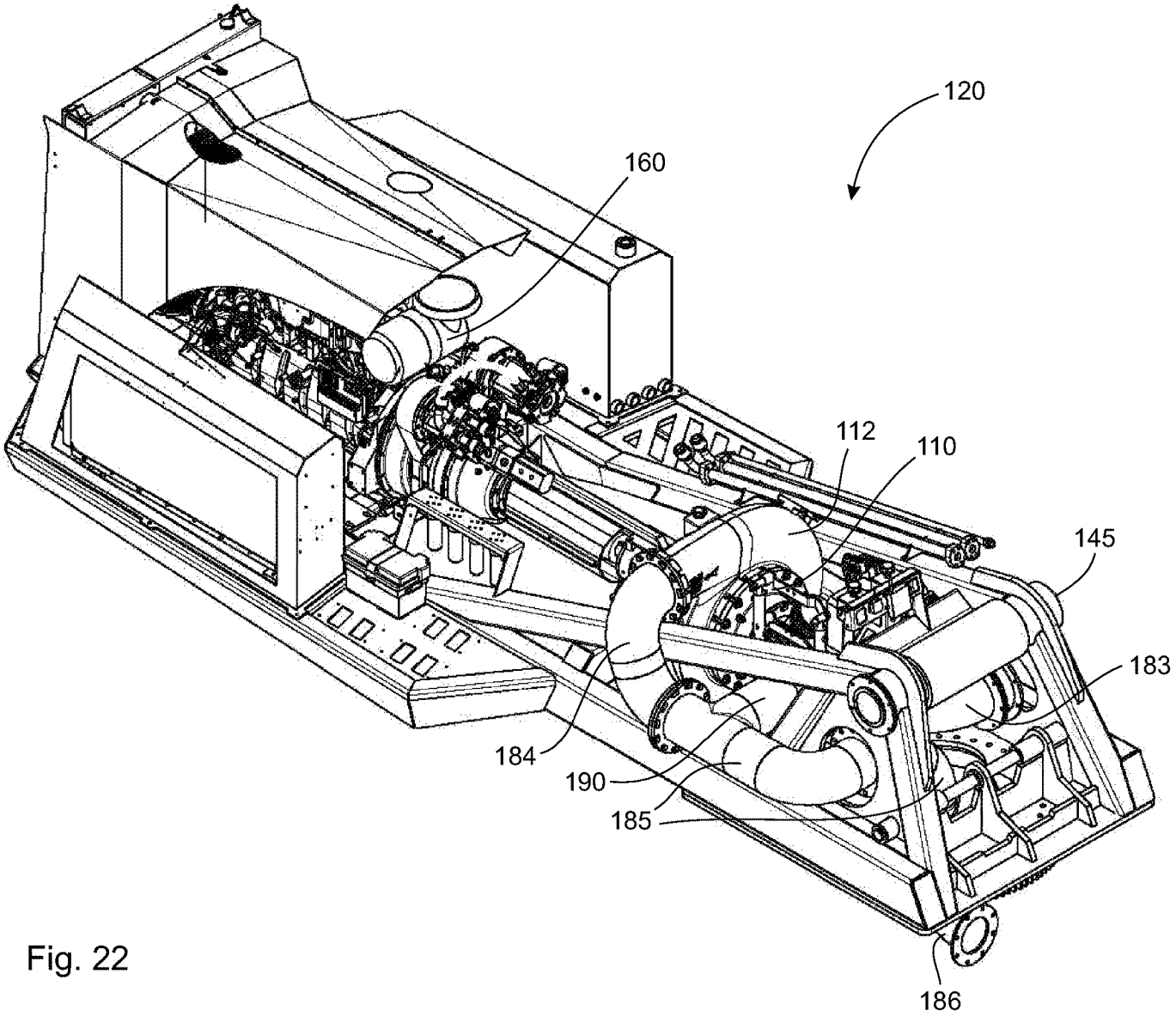
FIG. 22 depicts another top perspective view of the platform of the trailer of FIG. 16.

With specific reference to FIG. 15, a liquid pump 70, for example a liquid manure pump as described in U.S. Pat. No. 8,944,758 issued Feb. 3, 2015, the entire contents of which is herein incorporated by reference, is mounted on the boom 40 at a distal end of the boom 40. The liquid pump 70 is mounted on a pump mount 51 connected to the third boom section 43. The liquid pump 70 comprises a main pipe 73 and a pump head 71 mounted at a distal end of the main pipe 73, the pump head 71 immersible in a liquid reservoir such as a liquid manure lagoon. The pump head 71 is equipped with an impeller (not shown) driven by a hydraulic motor 72 in hydraulic communication through hydraulic fluid lines with the hydraulic pump 61. The main pipe 73 is in fluid communication with a fluid conduit 80 connected to a proximal end of the main pipe 73. Operation of the impeller in the pump head 71 forces liquid to flow into the main pipe 73 and thence into the fluid conduit 80. Some of the liquid flow may be diverted from the main pipe 73 through a knife valve 75 into an agitator nozzle 74. Pressurized liquid flow through the agitator nozzle 74 is used to mix the liquid in the liquid reservoir, which is especially useful for liquid manure lagoons, which have a high solids content. The agitator nozzle 74 can be swiveled around the main pipe 73 by virtue of swiveling mechanism 76 in order to change the direction of the pressurized liquid flow so that an area in the liquid reservoir entirely around the liquid pump 70 can be mixed.

The fluid conduit 80 is connected to the main pipe 73 at a distal end of the fluid conduit 80. A proximal end of the fluid conduit 80 is connected to a flow discharge outlet 81 situated on the frame 2 of the trailer 1. The fluid conduit 80 therefore extends between the main pipe 73 of the liquid pump 70 at the distal end of the boom 40 and the flow discharge outlet 81 on the frame 2. To protect the fluid conduit 80 from damage over the long length of the fluid conduit 80, the fluid conduit 80 is at least partially housed in the boom 40 nestled between the walls of the boom 40. Further, once the fluid conduit 80 reaches the proximal end of the boom 40, the fluid conduit 80 is routed between frame elements of the frame 2 so that the fluid conduit 80 is at least partially housed in the frame 2 before reaching the flow discharge outlet 81. In order for the fluid conduit 80 to continue from the boom 40 into the frame 2, the fluid conduit 80 passes through a central aperture 11 in the swivel 10 (see FIG. 14).

The hydraulic pump 61 is driven by a drive shaft of the engine 60. The engine 60 is preferably a combustion engine, more preferably a diesel engine. Fuel of the engine is stored in one or more fuel tanks 65 and supplied to the engine by fuel lines (not shown). The hydraulic pump 61 is used to operate all hydraulic components of the trailer 1 including the liquid pump 70, the first, second and third boom section hydraulic cylinders 48, 49, 50, the hydraulic swivel 10 and the stabilizer leg actuators 7. Hydraulic fluid lines (not shown) and hydraulic fluid valves (not shown) are used to complete hydraulic circuits that supply and control hydraulic fluid flow between the hydraulic pump 61 and the other hydraulic components of the trailer 1. Because the hydraulic pump 61, the liquid pump 70, the first, second and third boom section hydraulic cylinders 48, 49, 50 and the hydraulic swivel 10 are ultimately connected to the platform 20, rotation of the swivel 10 and therefore the platform 20 does not cause wrapping of the hydraulic fluid lines connecting the hydraulic pump 61 to the above-mentioned hydraulic components. The hydraulic fluid lines move with the platform 20 in synchronicity with the both the hydraulic pump 61 and the hydraulic components, therefore the hydraulic fluid lines do not need to be coiled through the swivel 10. However, because the stabilizer legs 6 are not mounted on the platform 20, the hydraulic fluid lines connecting the stabilizer leg actuators 7 to the hydraulic pump 61 should be disconnected once the stabilizer legs 6 are locked in the ground-engaging position, or a separate dedicated hydraulic pump could be used to power the stabilizer leg actuators 7.

FIG. 16 to FIG. 24B depict another embodiment of a liquid pumping trailer 100, which has many components in common with the liquid pumping trailer 1. There are three primary differences between the trailer 100 and the trailer 1.

First, the trailer 100 has an articulated boom 140 with first, second and third boom sections 141, 142 and 143, respectively, each of the boom sections 141, 142, 143 connected to respective neighboring boom sections through one or both of pivots 146 and 147 such that pivoting of the second and third boom sections 142 and 143, respectively, can be accomplished through an angle of 180°. The boom sections 141, 142 and 143 are therefore capable of extending further while being able to fold up completely on each other into a compact transport configuration. The first boom section 141 is pivotally connected to a platform 120 of the trailer 100 at pivot 145.

Second, the trailer 100 has a rigid fluid conduit 180 extending along an exterior of the boom 140 from a distal end of the fluid conduit 180 where the fluid conduit 180 is connected to a liquid pump 170 all the way to a proximal end of the fluid conduit 180 proximate a frame 102 of the trailer 100 where fluid in the fluid conduit 180 is ejected through a discharge outlet 189. The rigid fluid conduit 180 is made of hard steel or other strong material and is therefore more robust and less prone to damage than a flexible conduit made of rubber or another polymer. Thus, the fluid conduit does not need to be protected over its long length by housing the fluid conduit in the boom nestled between the walls of the boom. To run the fluid conduit 180 along the exterior of the boom 140 while permitting the boom sections 141, 142 and 143 to articulate, the fluid conduit 180 is passed from one side of the boom 140 through to the other side of the boom 140 at each articulation point proximate pivot 146 and pivot 147, as best seen in regions A and B in FIG. 16. Elbows 181 in the fluid conduit 180 are employed to redirect the fluid conduit 180 through an aperture in the boom 140 at the articulation points and then back along the exterior of the boom 140. When the boom sections 141, 142 and 143 articulate. The boom sections 141, 142 and 143 rotate about the fluid conduit 180 without twisting the fluid conduit 180.

Third, the trailer 100 has an additional liquid pump 110 that is mounted on the platform 120, as best seen in FIG. 21 to FIG. 24B. The additional fluid pump 110 is fluidically in-line with the fluid conduit 180 and is used to complement the pumping action of the liquid pump 170. The liquid pump 170 is at the distal end of the fluid conduit 180 beyond a distal end of the boom 140, while the additional fluid pump 110 is close to the discharge outlet 189 at a proximal end of the fluid conduit 180. The additional liquid pump 110 is preferably a high-pressure pump relative to the liquid pump 170. The additional liquid pump 110 provides extra pumping power for efficient transport of the liquid through the fluid conduit 180.

The additional fluid pump 110 is driven by an engine 160 either directly through a drive shaft 161 of the engine or through a clutch connecting the additional liquid pump 110 to the drive shaft 161 of the engine 160. The engine 160 and the additional fluid pump 110 are both mounted on the platform 120 on an opposite side of an axis of rotation of the platform 120 in relation to the boom 140. The additional liquid pump 110 therefore also provides extra weight on the platform 120 to help counterbalance the boom 140 allowing the boom 140 on the trailer 100 to be longer than the boom 40 on the trailer 1.

FIG. 21 to FIG. 24B shows details of how the additional fluid pump 110 is plumbed into the fluid conduit 180. Reference is made herein to conduit sections, which are sections of the fluid conduit 180. Liquid flowing through the fluid conduit 180 from the liquid pump 170 enters conduit section 182 between the boom 140 and the platform 120 to be delivered into conduit section 183 mounted on the platform 120. The conduit section 183 has an elbow that directs the liquid flow into an inlet 111 of the additional liquid pump 110. The additional liquid pump 110 pumps the liquid into conduit section 184 connected to an outlet 112 of the additional liquid pump 110, the outlet 112 having an elbow to direct the liquid flow to an opposite lateral side of the platform 120 where the fluid flows into the conduit section 184. The conduit section 184 has an elbow to redirect the liquid flow parallel to the lateral edge of the platform 120 where the liquid flows into conduit section 185. The conduit section 185 has elbows to redirect the liquid flow laterally back toward a centerline of the platform 120 and then down vertically through a central aperture 121 in the platform 120 where the liquid flows into conduit section 186. The conduit section 186 has an elbow to redirect the liquid flow longitudinally parallel to a longitudinal axis of the trailer 100 into conduit section 187 that delivers the liquid flow to conduit section 188 and finally out through the discharge outlet 189.

Figure 23:
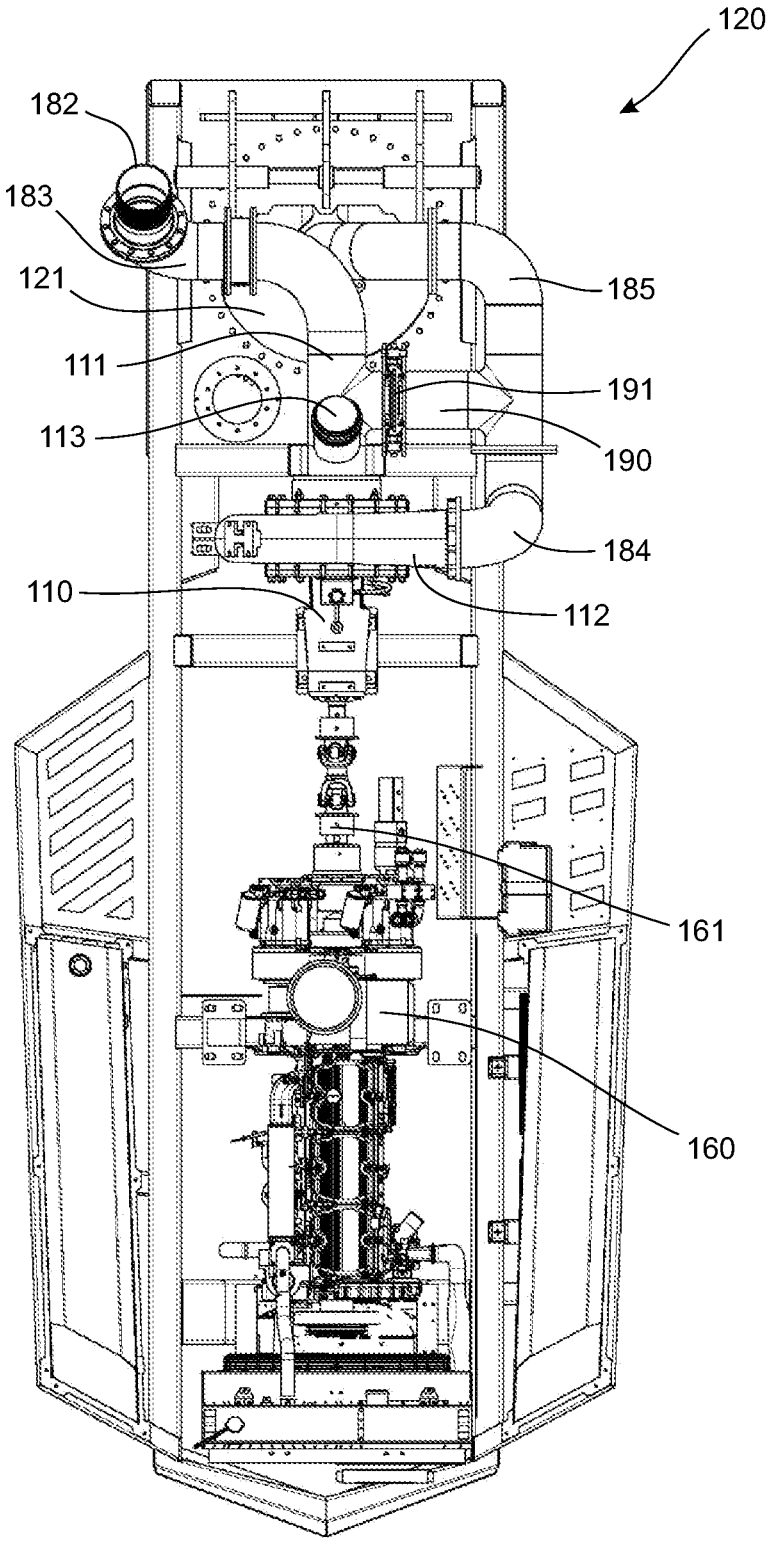
FIG. 23 depicts a top view of the platform of the trailer of FIG. 16 with various components removed to better illustrate a high-pressure pump and piping mounted on the platform.
Figure 24A:
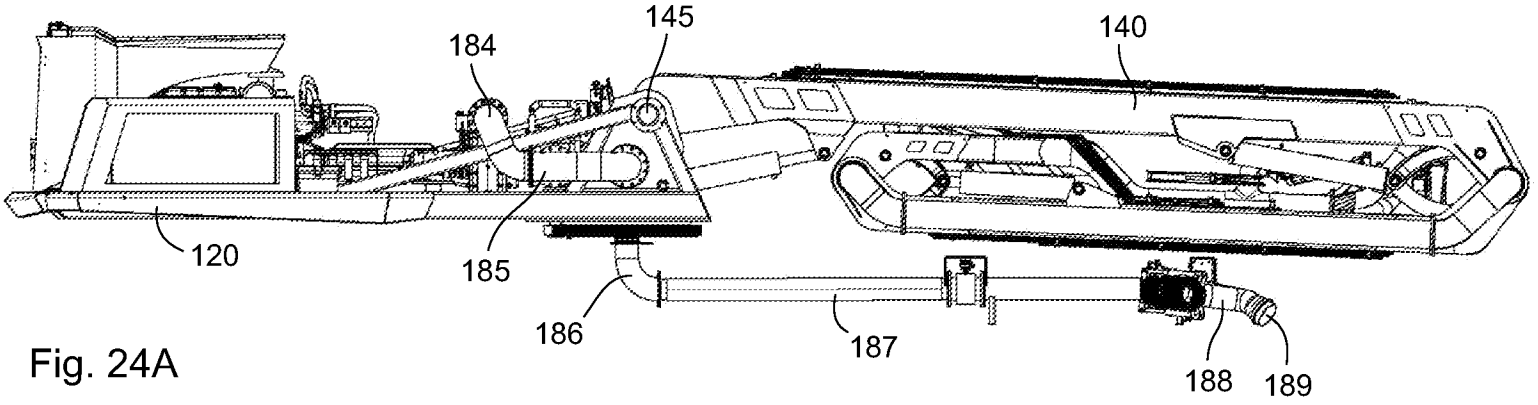
FIG. 24A depicts a side view of the platform of FIG. 23 in context with a frame of the trailer of FIG. 16.
Figure 24B:
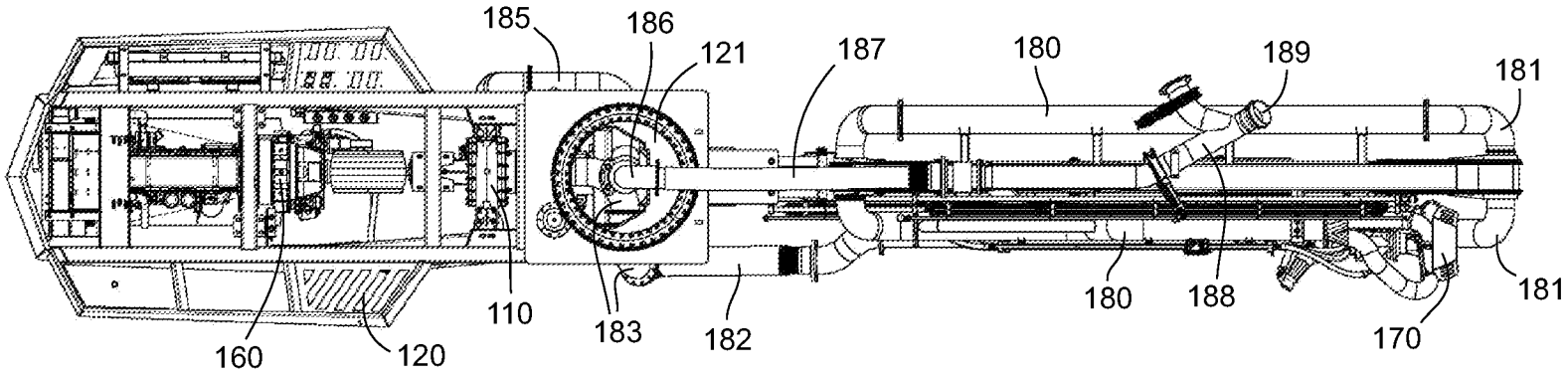
FIG. 24B depicts a bottom view of FIG. 24A.

With specific reference to FIG. 23, the fluid conduit 180 at the inlet 111 of the additional liquid pump 110 is equipped with a by-pass conduit 190 fluidly connecting the conduit section 185 to the inlet 111 of the additional liquid pump 110 through a valve 191. Operation of the valve 191 permits fluid leaving the additional liquid pump 110 to be recycled back into the additional liquid pump 110 to help regulate the liquid flow through the additional liquid pump 110. In addition, the inlet 111 is equipped with a clean-out port 113 to assist with maintenance of the additional liquid pump 110.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. A liquid pumping vehicle comprising:

a frame;

wheels mounted on the frame proximate a first end of the frame;

a platform mounted on a swivel, the swivel rotatably mounted on the frame centered over the wheels proximate the first end of the frame, the platform rotatable about a vertically oriented rotation axis relative to the ground;

an articulated boom mounted on the platform proximate a first end of the boom;

a first liquid pump mounted on the boom proximate a second end of the boom, the first liquid pump immersible in a liquid reservoir for pumping liquid out of the reservoir;

a second liquid pump mounted on the platform, the second liquid pump in fluid connection with a fluid conduit through which the first liquid pump pumps the liquid, the fluid conduit situated exterior to the boom and passing from one side of the boom to another side of the boom at articulation points on the boom;

an engine mounted on the platform, the engine operably connected to the first liquid pump and the second liquid pump for operating the first and second liquid pumps, the engine situated so that the rotation axis of the platform is between the boom and the engine and so that a first turning moment created on a first moment arm relative to the rotation axis by weight of the engine and other components on an engine-side of the platform is offset under operational conditions of the pumping vehicle by a second turning moment created on a second moment arm relative to the rotation axis by weight of the boom and other components on a boom-side of the platform; and, a flow discharge outlet, the flow discharge outlet connected to the second liquid pump by the fluid conduit through which the liquid is pumped by the first and second liquid pumps from the liquid reservoir to the flow discharge outlet.

2. The vehicle of claim 1, wherein the second liquid pump operates at higher pressure than the first liquid pump.

3. The vehicle of claim 1, wherein the second liquid pump is driven by a drive shaft of the engine.

4. The vehicle of claim 1, wherein the articulation points permit pivoting of boom arm sections through 180°.

5. The vehicle of claim 1, wherein the platform is continuously rotatable through 360°, and the engine, the second liquid pump and the boom are fixedly mounted on the platform to be carried by the platform as the platform is being rotated while maintaining the balance of the first turning moment and the second turning moment.

6. The vehicle according to claim 1, further comprising a direct-drive hydraulic pump mounted on the engine-side of the platform, the hydraulic pump driven by the engine, the hydraulic pump operatively connected to the first liquid pump for operating the first liquid pump.

7. The vehicle according to claim 6, wherein the first liquid pump comprises a hydraulic motor for operating the first liquid pump, the hydraulic motor operatively connected to the hydraulic pump by hydraulic fluid lines extending between the hydraulic pump and the hydraulic motor along the boom.

8. The vehicle of claim 7, wherein the operational conditions of the pumping vehicle comprise the hydraulic fluid lines being full of hydraulic fluid, the boom being extended and the fluid conduit containing liquid being pumped by the first and second liquid pumps.

9. The vehicle according to claim 1, further comprising stabilizer legs mounted on the frame, the stabilizer legs moveable between a ground-disengaging position and a ground-engaging position, the stabilizer legs assisting with stabilizing the vehicle on the ground when the stabilizer legs are in the ground-engaging position.

10. The vehicle according to claim 1, wherein the boom comprises at least two boom sections, the at least two boom sections pivotable relative to each other by one or more hydraulic cylinders connected between adjacent boom sections.

11. The vehicle according to claim 1, wherein the wheels comprise four wheels in a tandem axle configuration.

12. The vehicle according to claim 1, wherein the vehicle is a trailer.

13. The vehicle according to claim 1, wherein the liquid is liquid manure.

14. A liquid pumping vehicle comprising:

a frame;

wheels mounted on the frame proximate a first end of the frame;

a platform mounted on a swivel, the swivel rotatably mounted on the frame centered over the wheels proximate a first end of the frame, the platform rotatable about a vertically oriented rotation axis relative to the ground;

an articulated boom mounted on the platform proximate a first end of the boom;

a first liquid pump mounted on the boom proximate a second end of the boom, the first liquid pump immersible in a liquid reservoir for pumping liquid out of the reservoir;

a second liquid pump mounted on the platform, the second liquid pump in fluid connection with a fluid conduit through which the first liquid pump pumps the liquid, the fluid conduit situated exterior to the boom and passing from one side of the boom to another side of the boom at articulation points on the boom;

an engine mounted on the platform, the engine operably connected to the first liquid pump and the second liquid pump for operating the first and second liquid pumps, the engine situated so that the rotation axis of the platform is between the boom and the engine and so that a weight of the engine, second liquid pump and other components on an engine-side of the platform offsets a weight of the boom and other components on a boom-side of the platform; and, a flow discharge outlet, the flow discharge outlet connected to the second liquid pump by the fluid conduit through which the liquid is pumped by the first and second liquid pumps from the liquid reservoir to the flow discharge outlet.

15. The vehicle of claim 14, wherein the second liquid pump operates at higher pressure than the first liquid pump.

16. The vehicle of claim 14, wherein the second liquid pump is driven by a drive shaft of the engine.

17. The vehicle of claim 14, wherein the articulation points permit pivoting of boom arm sections through 180°.

18. The vehicle of claim 14, wherein the platform is continuously rotatable through 360°, and the engine, the second liquid pump and the boom are fixedly mounted on the platform to be carried by the platform as the platform is being rotated while maintaining the balance of the first turning moment and the second turning moment.

19. The vehicle according to claim 14, further comprising a direct-drive hydraulic pump mounted on the engine-side of the platform, the hydraulic pump driven by the engine, the hydraulic pump operatively connected to the first liquid pump for operating the first liquid pump.

20. The vehicle according to claim 19, wherein the first liquid pump comprises a hydraulic motor for operating the first liquid pump, the hydraulic motor operatively connected to the hydraulic pump by hydraulic fluid lines extending between the hydraulic pump and the hydraulic motor along the boom.

21. The vehicle of claim 20, wherein the operational conditions of the pumping vehicle comprise the hydraulic fluid lines being full of hydraulic fluid, the boom being extended and the fluid conduit containing liquid being pumped by the first and second liquid pumps.

22. The vehicle according to claim 14, further comprising stabilizer legs mounted on the frame, the stabilizer legs moveable between a ground-disengaging position and a ground-engaging position, the stabilizer legs assisting with stabilizing the vehicle on the ground when the stabilizer legs are in the ground-engaging position.

23. The vehicle according to claim 14, wherein the boom comprises at least two boom sections, the at least two boom sections pivotable relative to each other by one or more hydraulic cylinders connected between adjacent boom sections.

24. The vehicle according to claim 14, wherein the wheels comprise four wheels in a tandem axle configuration.

25. The vehicle according to claim 14, wherein the vehicle is a trailer.

26. The vehicle according to claim 14, wherein the liquid is liquid manure.

* * * * *